US011992872B2

(12) United States Patent
Dal Lago et al.

(10) Patent No.: US 11,992,872 B2
(45) Date of Patent: May 28, 2024

(54) MANUFACTURING FACILITY WITH A TOOL-CHANGING UNIT AND CLAMPING JAW, AND METHOD FOR CHANGING A TOOL

(71) Applicant: TRUMPF Maschinen Austria GmbH & Co. KG., Pasching (AT)

(72) Inventors: Matteo Dal Lago, Cologna Veneta (IT); Stefano Speziali, Foligno (IT); Andrea Ramin, Pasching (AT)

(73) Assignee: TRUMPF Maschinen Austria GmbH & Co. KG, Pasching (AT)

( * ) Notice: Subject to any disclaimer, the term of this patent is extended or adjusted under 35 U.S.C. 154(b) by 972 days.

(21) Appl. No.: 16/966,783

(22) PCT Filed: Feb. 19, 2019

(86) PCT No.: PCT/AT2019/060058
§ 371 (c)(1),
(2) Date: Jul. 31, 2020

(87) PCT Pub. No.: WO2019/161425
PCT Pub. Date: Aug. 29, 2019

(65) Prior Publication Data

US 2021/0039150 A1 Feb. 11, 2021

(30) Foreign Application Priority Data

Feb. 21, 2018 (AT) ..... A 50158/2018

(51) Int. Cl.
*B21D 5/02* (2006.01)
*B21D 5/04* (2006.01)

(52) U.S. Cl.
CPC ..... *B21D 5/0254* (2013.01); *B21D 5/047* (2013.01)

(58) Field of Classification Search
CPC ..... B21D 5/0254; B21D 5/047
See application file for complete search history.

(56) References Cited

U.S. PATENT DOCUMENTS 4,089,198 A * 5/1978 Amano ..... B21D 5/042 72/320
4,761,985 A 8/1988 Klingesberger
(Continued)

FOREIGN PATENT DOCUMENTS

CN 1180594 A 5/1998
CN 1490098 A 4/2004
(Continued)

OTHER PUBLICATIONS

International Search Report in PCT/AT2019/060058, mailed Jul. 4, 2019.

*Primary Examiner* — Teresa M Ekiert
(74) *Attorney, Agent, or Firm* — Collard & Roe, P.C.

(57) ABSTRACT

A tool-changing unit for a production plant for forming sheet metal using a bending operation. The tool-changing unit includes a tool-holding device having a carrier body and a number "n" of tool-holding modules arranged directly next to one another and held on the carrier body. Each one of the tool-holding modules includes a first coupler and a first actuating device cooperating therewith as a component of a coupling device, wherein the first coupler can be brought into coupling engagement and out of coupling engagement with an individual clamping jaw of a clamping jaw set. Moreover, a production plant has the tool-changing unit and the clamping jaw a method changes tools.

26 Claims, 7 Drawing Sheets

(56) References Cited

U.S. PATENT DOCUMENTS

| | | | | |
|---|---|---|---|---|
| 4,856,315 | A | 8/1989 | Salvagnini | |
| 5,168,745 | A | 12/1992 | Miyagawa et al. | |
| 5,941,116 | A | 8/1999 | Kunze | |
| 5,996,389 | A | 12/1999 | Kaltenbach | |
| 7,069,766 | B2 | 7/2006 | Hayashi et al. | |
| 7,343,774 | B2 | 3/2008 | Gascoin et al. | |
| 10,350,662 | B2 * | 7/2019 | Aigner | B21D 5/002 |
| 2004/0187552 | A1 | 9/2004 | Enderink | |
| 2017/0239701 | A1 | 8/2017 | Denkmeier | |

FOREIGN PATENT DOCUMENTS

| | | | |
|---|---|---|---|
| CN | 1500018 | A | 5/2004 |
| DE | 196 36 463 | A1 | 4/1998 |
| DE | 197 33 578 | A1 | 2/1999 |
| EP | 0 258 204 | A2 | 3/1988 |
| EP | 0 274 159 | A2 | 7/1988 |
| JP | S5962810 | U | 4/1984 |
| JP | S61103626 | A | 5/1986 |
| JP | H0584414 | U | 11/1993 |
| JP | 2002-079328 | A | 3/2002 |
| WO | 00/59655 | A1 | 10/2000 |
| WO | 2013/001491 | A1 | 1/2013 |

* cited by examiner

MANUFACTURING FACILITY WITH A TOOL-CHANGING UNIT AND CLAMPING JAW, AND METHOD FOR CHANGING A TOOL

CROSS REFERENCE TO RELATED APPLICATIONS

This application is the National Stage of PCT/AT2019/060058 filed on Feb. 19, 2019, which claims priority under 35 U.S.C. § 119 of Austrian Application No. A 50158/2018 filed on Feb. 21, 2018, the disclosure of which is incorporated by reference. The international application under PCT article 21(2) was not published in English.

BACKGROUND OF THE INVENTION

Field of the Invention

The invention relates to a tool-changing unit, a production plant with the tool-changing unit and a clamping jaw with at least one upper clamping jaw segment and at least one clamping jaw set of multiple individual clamping jaws, as well as to a method for changing tools in such a production plant.

Description of the Related Art

From EP 0 274 159 A2, a generically formed bending machine for sheet metals with a fixed counterhold and holding-down tool, which is movable towards and away from said counterhold, for the sheet metal to be clamped, as well as a tool-changing unit for the tool changing of individual clamping jaws of the clamping tool has become known. Here, the tool-changing unit comprises a number "n" of tool-holding modules arranged directly next to one another, wherein each tool-holding module comprises a first coupling means as a component of a coupling device. The first coupling means can further be brought into coupling engagement or out of coupling engagement with one of the individual clamping jaws.

The documents U.S. Pat. No. 5,168,745 A, JP 2002-079328 A and WO 2013/001491 A1 further generally describe bending machines with clamping tools held thereon for forming sheet metals.

EP 0 258 204 A2 describes a device for folding sheet metal blanks, in which the holding-down punch of the holding-down tool is formed of multiple segments. The holding-down punches are mounted so as to be displaceable in a guide of the holding-down tool parallel to the folding axis and can be displaced with the aid of an adjusting rod. For this purpose, the segments each have a coupling to allow for optional coupling of the segments with either the actuating rod or the holding-down tool. The segments are arranged on both sides of a middle segment and assembled to a row. The middle segment can be removed from the segment row by the aid of a slider mounted in the holding-down tool so as to be displaceable in the setting direction of the holding-down tool to allow for it to either be exchanged by another middle segment or to make room in the holding-down punch for inward pushing of the edge segments. For changing the middle segments, a changing device which is connected to a memory is attached to the side of the slider in the upper rest position of the slider. By means of this changing device for the tools, it was possible to change one of the middle segments at a time; however, a relatively time-consuming changing operation was required for doing so.

SUMMARY OF THE INVENTION

It was the object of the present invention to overcome the shortcomings of the prior art and to provide a tool-changing unit, a production plant with such a tool-changing unit and a clamping jaw, in particular an upper clamping jaw having at least one clamping jaw set of multiple individual clamping jaws and a method for changing tools in a production plant, by means of which a user is capable of carrying out an easy change of tools that especially requires a short period of time, in order to increase productivity of the production plant.

This object is achieved by means of a tool-changing unit, a production plant with such a tool-changing unit and a clamping jaw, in particular an upper clamping jaw having at least one clamping jaw set of multiple individual clamping jaws and a method for changing tools in a production plant according to the claims.

The tool-changing unit according to the invention is provided for a production plant for producing workpieces from sheet metal, in particular by means of forming by swivel bending or swing bending and for setting an active clamping length of a clamping tool, in particular a clamping jaw set comprising multiple individual clamping jaws, wherein the tool-changing unit comprises a tool-holding device, and in this regard

- the tool-holding device comprises a carrier body,
- the tool-holding device comprises a number "n" of tool-holding modules arranged directly next to one another, and each one of the tool-holding modules is held on the carrier body, and further
  - each tool-holding module comprises a first coupling means as a component of a coupling device, wherein the first coupling means can be brought into coupling engagement or out of coupling engagement with one of the individual clamping jaws, and in this regard
  - each tool-holding module comprises a first coupling means and a first actuating means cooperating with the first coupling means, wherein the first coupling means can be brought into coupling engagement or out of coupling engagement with one of the individual clamping jaws by means of the first actuating means.

The advantage achieved by this is that a separate tool-changing unit has been created which comprises a tool-holding device held on a separate carrier body. In this regard, the tool-holding device comprises a plurality of tool-holding modules which are arranged directly next to one another and can optionally be brought into coupling engagement with at least one or multiple ones of the tool clamping jaws of the clamping jaw set. Each one of the tool-holding modules has a separate first coupling means and a first actuating means cooperating therewith. When the first actuating means is actuated or activated, the first coupling means is brought into coupling engagement with one of the individual clamping jaws. Hence, by providing a plurality of tool-holding modules, which are preferably designed equally, individual or multiple ones of the individual clamping jaws can be quickly removed from or inserted into the clamping beam, in particular its clamping beam holder. Once the removal operation or the inserting operation of the individual clamping jaw or the individual clamping jaws has been carried out, the adjustment or displacement of the segments of the clamping jaw, in particular of the upper clamping jaw, arranged on the clamping beam can be carried out by a separate adjusting unit independently of the tool-changing unit and the segments can hence be pushed together to form a unit.

A further possible embodiment has the features that the tool-holding modules are arranged in a common base body and the base body is delimited by a first longitudinal end face and a second longitudinal end face and by a first transverse end face and a second transverse end face and the base body is held on the carrier body. Hence, despite the provision of multiple tool-holding modules arranged next to one another, a stable and single-piece base body can be used.

It can further be advantageous if the tool-holding modules each comprise a base body having a circumferential contour formed essentially flat in profile, wherein each base body is delimited by a first and a second flat side, by a first and a second longitudinal end face and by a first and a second transverse end face, and the tool-holding modules abut on one another on the flat sides facing one another in each case and the first transverse end face faces the carrier body and each base body is held on the carrier body. Hence, due to the circumferential contour, which is flat in profile, of the individual tool-holding modules, a plurality of tool-holding modules can be arranged directly next to one another in a minimum of space. Hence, due to the preferably plate-shaped base body of each tool-holding module, the design and arrangement of the coupling means and the actuating means as well as the necessary supply and discharge lines for the actuating medium, which is preferably formed by a pressure medium, can be carried out within this tool-holding modules with minimum space requirements.

Another embodiment is characterized in that the first coupling means are arranged in the region of the first longitudinal end face of the base body or the base bodies of the tool-holding modules. Thus, despite the plate-shaped design of the base body, a simple arrangement of the first coupling means can be provided, to hence also allow for easy and safe receiving of the individual tool-holding modules on the individual clamping jaws.

A further possible embodiment has the features that the tool-holding modules each comprise a second coupling means and a second actuating means cooperating with the second coupling means and that, with respect to the first coupling means, the second coupling means is arranged on the second longitudinal end face of the base body or the base bodies opposite to the first coupling means. By providing a second coupling means as well as the second actuating means cooperating therewith, hence, even better holding of the individual clamping jaws on the tool-holding modules of the tool-holding device can be created and achieved.

In a further embodiment, it is provided for that the coupling means are in each case formed by a coupling body accommodated in the base body and adjustable relative to the base body or formed by an electromagnet. Thus, depending on the choice and design of the coupling means, either a coupling device on a mechanical basis or a coupling device driven or actuated by electric current can be created.

Another embodiment is characterized in that the coupling bodies are formed by spheres, rotational ellipsoids or cylinders. Hence, depending on the choice of the coupling bodies, safe coupling engagement can be allowed for.

A further preferred embodiment is characterized in that the actuating means in each case comprise an actuating piston, and the actuating pistons are each accommodated in an actuating piston space arranged in the base body and, therein, these are mounted so as to be guided in the direction of an axis of the actuating piston space. Hence, by the formation of the actuating means as an actuating piston, an actuation and adjustment of the latter by a pressure medium, such as compressed air or a hydraulic fluid can be allowed for. Hence, sufficiently high actuating and coupling forces can be achieved also in a minimum of space.

It can further be advantageous if at least one first pressure medium line and at least one second pressure medium line are provided in the base body and the pressure medium line is in each case fluidically connected to the actuating piston space, and the first and second pressure medium lines each open into the actuating piston space on sides of the actuating piston accommodated in the actuating piston space facing away from one another. Hence, by arranging and providing separate pressure medium lines in each one of the base bodies, each one of the actuating piston spaces can optionally be applied with the pressure medium and thus the adjusting movements of the respective actuating piston accommodated in the actuating piston space can be effected.

Another alternative embodiment is characterized in that the actuating pistons each have at least one actuating surface aligned so as to extend tilted with respect to the axis of the actuating piston space, on which actuating surface, in each case, one of the coupling bodies is supported so as to abut thereon at least when the coupling body is in coupling engagement. Hence, by the actuating surface aligned to extend tilted with respect to the axis of the actuating piston space, the adjusting movement of the coupling body can be exerted in the manner of a wedge effect in a predetermined orientation in relation to the adjusting direction and in particular by means of a guide.

A further possible and optionally alternative embodiment has the features that the actuating surfaces are each formed as a frustum surface. If the actuating surface is formed as a frustum surface, additional guide arrangements between the actuating piston and the base body can be dispensed with.

In a further design, it is provided for that each one of the coupling bodies can be displaced from a coupling position projecting beyond the longitudinal end face into a release position located above the base body or the base bodies by means of the actuating piston cooperating with the coupling body. Hence, depending on the position of the coupling body, each one of the tool-holding modules can be adjusted from the coupling position into the release position. Depending on the arrangement, resetting can also be effected automatically by gravity and only after release from the actuating piston.

Another embodiment is characterized in that at least one pressure piston is provided in each one of the tool-holding modules, said at least one pressure piston being accommodated in a pressure piston space arranged in the base body or in the base bodies and being mounted so as to be guided therein in the direction of an axis of the pressure piston space. By providing at least one additional pressure piston, hence, an actuating force starting out from the tool-holding modules onto the respectively coupled individual clamping jaw can be exerted. This is particularly advantageous for a dispensing operation of the individual clamping jaws from the tool-holding device.

A further preferred embodiment is characterized in that the pressure pistons are each arranged such in the base body or in the base bodies that these can be adjusted from a pressure position projecting beyond the second transverse end face into a rest position located within the base body or the base bodies. Hence, safe release of the coupling engagement can be achieved also in case of possible jamming of the coupling means of the coupling device.

It can further be advantageous if a third pressure medium line is provided in each one of the tool-holding modules and, in each case, the third pressure medium line is fluidically connected to the pressure piston space on its side facing the first transverse end face. Thus, the adjusting movement of the pressure piston into at least one adjusting direction can be ensured.

Another embodiment is characterized in that a number "o" of valve arrangements, which is equal to the number "n" of tool-holding modules, each having at least one first pressure medium connection and one second pressure medium connection for each one of the tool-holding modules is provided, and, in each case, the first pressure medium line and the third pressure medium line are jointly fluidically connected to the first pressure medium connection and, in each case, the second pressure medium line is fluidically connected to the second pressure medium connection. By selecting the equal number of valve arrangements and tool-holding modules, hence, each one of the tool-holding modules can be controlled independently and the coupling engagement can be activated or deactivated.

However, the object of the invention can also be achieved by a production plant for producing workpieces from sheet metal, in particular by means of forming by swivel bending or swing bending, wherein the production plant comprises a bending machine having a fixed machine frame, a lower clamping beam and an upper clamping beam, wherein one of the clamping beams is adjustable relative to the machine frame, a bending unit, a clamping tool having a lower clamping jaw and an upper clamping jaw, wherein the lower clamping jaw is held releasably clamped on the lower clamping beam and the upper clamping jaw is held releasably clamped on the upper clamping beam in order to hold the workpiece to be produced clamped between the two clamping jaws at least during the bending operation, and wherein at least the upper clamping jaw comprises at least one upper clamping jaw segment and at least one clamping jaw set of multiple individual clamping jaws in a total number "m", wherein a-one clamping surface each with a forming edge is defined by the at least one upper clamping jaw segment and the individual clamping jaws, and each of said clamping surfaces have a connecting section arranged at a distance therefrom, and wherein the clamping surfaces can be turned towards the workpiece to be clamped and the connecting section serves for clamping retention on the clamping beam of the production plant, wherein each of the individual clamping jaws further comprises one coupling section as a component of a coupling device, wherein the coupling section delimits a groove-shaped receiving opening with a first groove side face, a second groove side face and a groove base surface, wherein the groove side faces each extend, in a perpendicular alignment with respect to the forming edge as well as in a preferably parallel alignment with respect to the clamping surface, to the side facing away from the forming edge, and wherein a third coupling means is arranged or formed in or on each one of the first groove side faces, said third coupling means being configured such that it can be brought into coupling engagement with a first coupling means of a tool-holding module of a tool-holding device, and further comprises a tool-changing unit designed according to the invention.

The advantage achieved by this is that a production plant can be created in which, using the tool-changing unit as well as the clamping jaw, in particular the upper clamping jaw, according to the invention, a quick change of tools can be carried out and hence the productive time of the entire production plant can be increased.

A further advantage is that the upper clamping jaw, in addition to the clamping jaw segment(s), comprises a separate clamping jaw set of a plurality of individual clamping jaws. The fact that multiple individual clamping jaws, some of which have different clamping jaw thick-nesses or clamping jaw widths, are used in a predetermined total number, allows for the active length of the forming edge required for the respective bending operation to be adjusted quickly and easily. Due to the fact that each one of the individual clamping jaws, as a component of the coupling device, also additionally comprises a coupling section, hence, each one of the individual clamping jaws can be gripped and coupled by means of the tool-holding device and its tool-holding modules. By designing the coupling section as a groove-shaped or U-shaped receiving opening, hence, the inserting operation of the individual tool-holding modules can be carried out easily. In this regard, the groove side faces which in each case delimit the groove-shaped receiving openings can be formed on additional webs which can be attached to the individual clamping jaws in a flat profile-like design or in the same width or thickness according to the respective individual clamping jaw. In this regard, the groove base surface can be formed directly by the individual clamping jaw itself. By providing the separate third coupling means in or on each one of the first groove side faces, hence, a coupling engagement between one of the tool-holding modules and the selected individual clamping jaw can be allowed for at least on one of the groove side faces.

It can further be advantageous if a total thickness of the individual clamping jaws in their total number "m" in the direction of their forming edge essentially corresponds to a construction length of the tool-holding modules arranged next to one another in their number "n". Hence, it is ensured that the total number of individual clamping jaws can always be changed or replaced at once by means of the tool-changing unit.

In a further design, it is provided for that a fourth coupling means is arranged or formed in or on each one of the second groove side faces. Hence, a safe and opposing coupling connection between the respective tool-holding module and the individual clamping jaw can be created.

Another embodiment is characterized in that the third and/or fourth coupling means are each formed by a V-shaped recess when viewed in cross-section of the groove-shaped receiving opening. Hence, in the cooperation with the respective coupling body, an additional pressing force of the respective base body of the tool-holding module onto the groove base surface can be built up.

A further preferred embodiment is characterized in that the groove side faces are each provided with an inlet chamfer on their end sections facing away from the groove base face. Hence, in case of possible projecting of a coupling body prior to the inserting operation into the groove-shaped receiving opening, safe resetting of the coupling body into its rest position located within the base body can be ensured.

The object of the invention can also be achieved independently by a method for changing tools in a production plant for producing workpieces from sheet metal, in particular by means of forming or swivel bending or swing bending, in particular using production plant with a tool-changing unit designed according to the invention, according to the following steps:

providing a bending machine having a fixed machine frame, a lower clamping beam and an upper clamping beam, wherein one of the clamping beams can be adjusted relative to the machine frame, providing a bending unit, providing a tool-changing unit having a tool-holding device, said tool-holding device comprising a carrier body as well as a number "n" of tool-holding modules arranged directly next to one another, and the tool-holding modules are held on the carrier body, forming each one of the tool-holding modules so as to have a first coupling means and a first actuating means cooperating with the first coupling means as a component of a coupling device, providing a clamping tool having a lower clamping jaw and an upper clamping jaw, wherein the lower clamping jaw is held releasably clamped on the lower clamping beam and the upper clamping jaw is held releasably clamped on the upper clamping beam in order to hold the workpiece to be produced clamped between the two clamping jaws at least during the bending operation, providing at least one upper clamping jaw segment and at least one clamping jaw set of multiple individual clamping jaws to form the upper clamping jaw, forming the individual clamping jaws to each have a clamping surface with a forming edge and a connecting section arranged at a distance therefrom, wherein the clamping surface can be turned towards the workpiece to be clamped and the connecting section is held releasably clamped on the upper clamping beam, forming the individual clamping jaws to each have a coupling section as a component of a coupling device, wherein each coupling section delimits a groove-shaped receiving opening with a first groove side face, a second groove side face and a groove base surface, forming a third coupling means in or on each one of the first groove side faces, inserting the tool-holding modules of the tool-changing unit into the groove-shaped receiving openings of the individual clamping jaws, adjusting or activating at least one selected first actuating means, wherein in the course of this, the first coupling means of the tool-holding module associated with the first actuating means is brought into coupling engagement with the third coupling means of an individual clamping jaw, releasing the clamping retention of the upper clamping jaw, displacing the tool-changing unit along with the at least one individual clamping jaw held coupled thereon.

The advantage achieved by this consists in that by the approach selected here and the use of the tool-changing unit as well as the clamping jaw set of the individual clamping jaws according to the invention, a tool-changing operation can be carried out quickly and in the shortest possible period of time. Due to the shortened tool-changing operation, hence a clamping tool adapted to the respective bending operation is available in an even shorter period of time, with which the further bending operations can be carried out without great interruptions.

Another alternative approach is characterized in that after the removal of the at least one individual clamping jaw, the at least one upper clamping jaw segment remaining on the upper clamping beam and the remaining individual clamping jaw(s) are adjusted into a position where they abut on one another by means of an adjusting unit. By providing a separate additional adjusting unit to the tool-changing unit, hence, adjusting operations and changing operations can be carried out in parallel.

A further possible and optionally alternative approach has the features that the at least one individual clamping jaw removed from the upper clamping beam by the tool-changing unit are either inserted and held outside the bending region and thus laterally on the upper clamping beam or are passed on to a tool storage. Hence, the required time for changing tools and the beginning of a new clamping and bending operation can be additionally shortened.

The object of the invention can also be achieved autonomously and independently by a method for changing tools in a production plant for producing workpieces from sheet metal, in particular by means of forming by air bending or bottom bending, by means of a bending machine provided and designed for this purpose, according to the following steps:

providing a bending machine having a fixed machine frame, a lower press beam and an upper press beam, wherein one of the press beams can be adjusted relative to the machine frame, providing a tool-changing unit having a tool-holding device, said tool-holding device comprising a carrier body as well as a number "n" of tool-holding modules arranged directly next to one another, and the tool-holding modules are held on the carrier body, forming each one of the tool-holding modules so as to have a first coupling means and a first actuating means cooperating with the first coupling means as a component of a coupling device, providing a bending tool having a bending die and a bending punch, wherein the bending die is held releasably clamped on the lower press beam and the bending punch is held releasably clamped on the upper press beam, to allow for the bending operation to be carried out on the workpiece to be produced, providing at least one bending punch segment and at least one bending punch set comprising multiple individual bending punches to form the bending punch, forming the individual bending punches to each have a forming edge and a connecting section arranged at a distance therefrom, wherein the forming edge can be turned towards the workpiece to be formed and the connecting section is held releasably clamped on the upper press beam, forming the individual bending punches to each have a coupling section as a component of a coupling device, wherein each coupling section delimits a groove-shaped receiving opening with a first groove side face, a second groove side face and a groove base surface, forming a third coupling means in or on each one of the first groove side faces, inserting the tool-holding modules of the tool-changing unit into the groove-shaped receiving openings of the individual bending punches, adjusting or activating at least one selected first actuating means, wherein in the course of this, the first coupling means of the tool-holding module associated with the first actuating means is brought into coupling engagement with the third coupling means of an individual bending punch, releasing the clamping retention of the bending punch, displacing the tool-changing unit along with the at least one individual bending punch held coupled thereon.

The advantage that can be achieved by this is that a production plant can be created in which, using the tool-changing unit as well as the bending tool, in particular the bending punch with its bending punch components for forming the coupling device, according to the invention, a quick change of tools can be carried out and hence the productive time of the entire production plant can be increased.

BRIEF DESCRIPTION OF THE DRAWINGS

For the purpose of better understanding of the invention, it will be elucidated in more detail by means of the figures below.

These show in a respectively very simplified schematic representation.

DETAILED DESCRIPTION OF PREFERRED EMBODIMENTS

Figure 1:
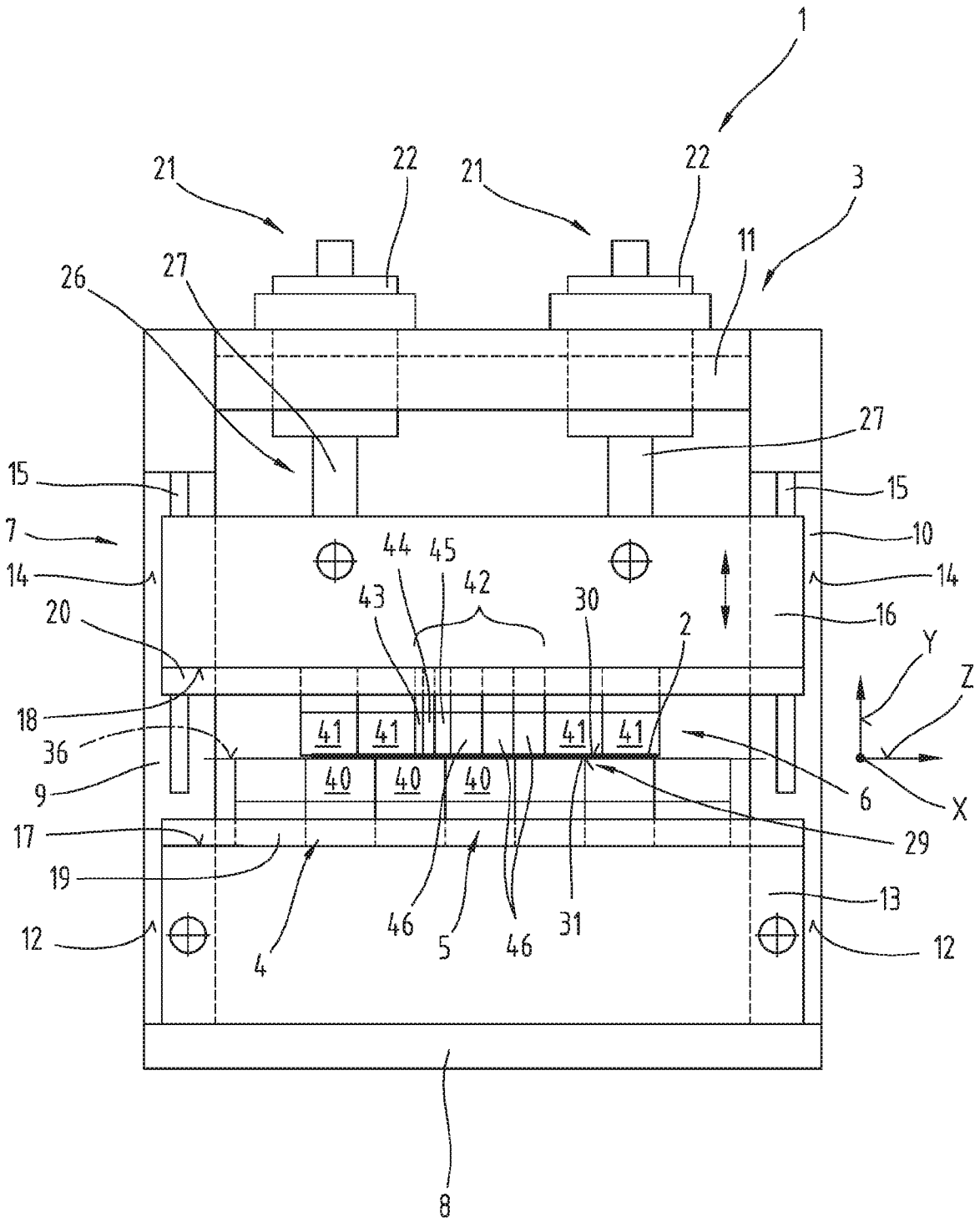
FIG. 1 a view of a production plant with a bending machine, the support table being removed and the tool-changing unit being removed.
Figure 2:
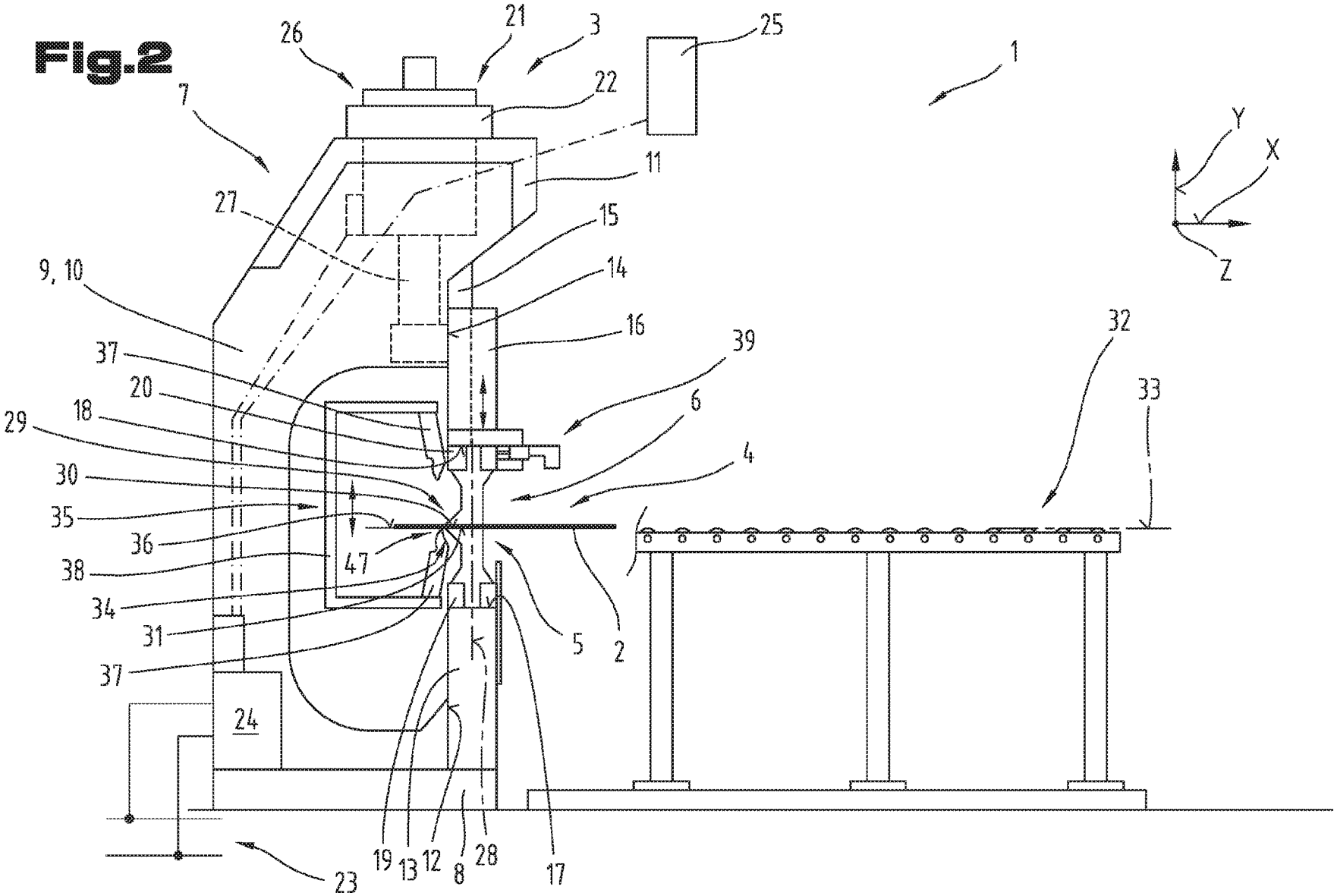
FIG. 2 a lateral view of the production plant according to FIG. 1 with the tool-changing unit for the upper clamping jaw.

First of all, it is to be noted that in the different embodiments described, equal parts are provided with equal reference numbers and/or equal component designations, where the disclosures contained in the entire description may be analogously transferred to equal parts with equal reference numbers and/or equal component designations. Moreover, the specifications of location, such as at the top, at the bottom, at the side, chosen in the description refer to the directly described and depicted figure and in case of a change of position, these specifications of location are to be analogously transferred to the new position.

The term "particularly/in particular" is hereinafter understood such that it may refer to a possible, more specific embodiment and more detailed specification of a subject matter or a method step, but does not necessarily have to represent an obligatory, preferred embodiment of the latter or an approach.

FIGS. 1 to 6 in a highly simplified schematic representation show a production plant 1 as well as components thereof, which are in the present case in particular formed for swivel bending or swing bending of workpieces 2 to be produced from sheet metal. Usually, a metallic material, which may be referred to as flats/panel in its undeformed state, is used as a source material. Thus, the production plant 1 can also be referred to a swivel bending plant or swing bending plant.

The production plant 1 used for bending in the present case comprises a bending machine 3, in particular a press, which is inter alia designed to clampingly hold the workpiece 2 or workpieces to be manufactured from the sheet metal between a clamping tool 4 adjustable relative to one another. The clamping tool 4 in the present exemplary embodiment comprises a lower clamping jaw 5 and an upper clamping jaw 6 cooperating therewith. The lower clamping jaw 5 can comprise multiple lower clamping jaw segments 40 and the upper clamping jaw 6 can comprise multiple upper clamping jaw segments 41, wherein these are described in further detail below. The lower clamping jaw 5 can also be referred to as lower cheek or counterhold and the upper clamping jaw 6 can also be referred to as upper cheek or holding-down tool. The lower clamping jaw 5 can also be designed as a continuous separate punch. For adjustment to different dimensions of the sheet metal blank to be bent, the upper clamping jaw segments 41 can have different thicknesses or widths as compared to one another and can form a holding-down punch in their slid together working position, which is assembled to a unit.

In a coordinate system for such bending machines 3, the "x" direction is generally direction referred to as the direction extending in perpendicular orientation in a horizontal plane with respect to the longitudinal extension of the respective clamping jaws 5, 6. Thus, this is the direction which corresponds to the feed direction or the removal direction.

The "y" direction is understood as the vertical direction which thus extends in the height direction of the clamping jaws 5, 6. Lastly, the "z" direction is understood as the direction into which the longitudinal direction or the longitudinal extension of the clamping jaws 5, 6 extends. Hence, the longitudinal extension of the forming or bending edge described below is also oriented extending in the "z" direction. The indicated directions ("X", "Y" and "Z") each also define spatial axes.

At this, the upper clamping jaw 6 is arranged above the workpiece 2 to be produced on the bending machine 3 and is held, in particular clamped, there sufficiently firmly. The lower clamping jaw 5 is also held, in particular clamped, on the bending machine 3.

A machine frame 7 of the bending machine 3 for example comprises side walls 9, 10 vertically rising from a base plate 8, having a distance from one another and being arranged in parallel to one another. These are preferably connected to one another by a massive cross connection 11 for example formed from a sheet metal preform on their end regions distanced from the base plate 8. The machine frame 7 usually is a solid component of the bending machine 3 preferably fixed on an even hall floor. The presently shown form was selected merely by way of example of a plurality of other possible designs.

The side walls 9, 10 may preferably be formed approximately in a C-shape for the formation of a free space for forming the workpiece 2, wherein a fixed lower clamping beam 13, particularly standing on the base plate 8, which can also be referred to a press beam, is mounted to front end faces 12 of near-base limbs of the side walls 9, 10. This preferably stationarily arranged and fixed lower clamping beam 13 may also be referred to as clamping table, which parts of the clamping tool 4 (in particular the lower clamping jaw 5) are also arranged on and held on.

On front end faces 14, an upper clamping beam 16, in particular a pressure beam, adjustable relative to the lower clamping beam 13 is mounted in a guided manner on limbs distanced from the base plate 8 in clamping beam guides 15. The clamping beam guides 15 are usually formed as linear guides in most diverse embodiments. This upper clamping beam 16 may also be referred to as press beam, which is, however, guided on the machine frame 7 so as to be movable relative thereto. On end faces 17, 18 opposing one another and extending in parallel to one another of the two clamping beams 13, 16, clamping jaw mounts 19, 20 for equipment with the clamping tool(s) 4, in particular the lower and upper clamping jaws 5, 6 may be and arranged. The clamping tool(s) 4 may also may also be held on the clamping jaw mounts 19, 20 with interposition of an adapter which is not represent in more detail herein.

The shown bending machine 3 may comprise at least one driving means 22 operated with electric energy as a driving arrangement 21 for the adjustable upper clamping beam 16, namely the pressure beam. The driving means 22 is/are line-connected to a controller 24 fed from an energy grid 23, as indicated only in FIG. 2. The operation of the bending machine 3 may for example be controlled via an input terminal 25 which is line-connected or communication-connected with the controller 24.

The driving means 22 are preferably electro-motor driven spindle drives 26, as are generally known, by means of which adjusting means 27 for a reversible adjusting movement of the upper clamping beam 16 formed by the pressure beam are for example drive-connected to it. However, other driving means 22 known from the prior art, such as cylinder-piston arrangements, stepper motors, rack and pinion drives or the like, may also be used.

Further details required for the operation of such a bending machine 3, such as safety installations, stopping arrangements and/or control devices, are not addressed in the present description so as to avoid an unnecessary length of the description.

Moreover, it is represented here in a simplified manner that the two clamping beams 13, 16, in particular their tool holders 19, 20, or the clamping tool 4 held thereon with its lower and upper clamping jaw(s) 5, 6, when looked at in the longitudinal direction of the clamping beams 13, 16, define an adjusting plane 28 extending therebetween. The adjusting plane 28 preferably extends centrally in relation to the clamping beams 13, 16 or the clamping jaw mounts 19, 20 arranged on these. In the present exemplary embodiment, here, a vertically directed plane is meant, which is spanned by the directions or axes, namely the "Y" axis and the "Z" axis, described above. The two clamping jaws 5, 6 form a clamping region 29 between themselves and on ends facing one another. Lower and upper clamping surfaces 30, 31 facing one another of the two clamping jaws 5, 6 are preferably oriented at right angles relative to the adjusting plane 28. These clamping surfaces 30, 31 serve the purpose of holding the sheet metal positioned between the two clamping jaws 5, 6 according to its wall thickness for performing the bending operation.

An additional support table 32 with its support surface defining a support plane 33 is preferably arranged in the region of the front side or the loading side of the bending machine 3. The support plane 33 may also be referred to as supporting plane. In this respect, it is to be noted that the support surface does not have to be formed over the entire surface, but may also be formed of multiple partial support surfaces arranged next to one another and/or behind one another in the feed direction of the sheet metal to be processed. The support surface 33 defined by the support plane preferably is arranged on the same plane as the lower clamping surface 30 of the lower clamping jaw 5. This serves as additional support for larger sheet metals in order to prevent unintentional buckling and the associated damage to thinner sheet metals.

A bending region 34 is referred to as the region which serves for forming the workpiece 2 to be manufactured from the usually planar still undeformed sheet metal or further processing an already preformed workpiece 2, by at least one additional bevel or crimp being formed.

The bending region 34 is usually located at a distance from the adjusting plane 28 of the clamping beams 13, 16 and is formed by end sections facing one another of at least one, but preferably both clamping jaws 5, 6. In the present exemplary embodiment, the bending region 34 is arranged on a side of the clamping beams 13, 16 facing away from the support table 32 or from an operating person not shown in further detail. Thus, the bending region 34 is arranged extending within the machine frame 7.

The bending region 34 usually forms a preferably straight bending line on the workpiece 2 to be manufactured, wherein limbs respectively form on both sides of the bending region 34 in consequence of the performed bending operation. One of the limbs of the workpiece 2 is held in clamping position between the two clamping surfaces 30, 31 of the clamping jaws 5, 6, wherein the at least one further limb is located outside of the clamping surfaces 30, 31. Depending on the desired geometry/the geometry that is to be manufactured of the workpiece 2, the two limbs form a bending angle between one another. This bending angle is measured in a reference plane that is vertical in relation to the bending line. The reference plane, in turn, is preferably also oriented extending in vertical direction in relation to the adjusting plane 28.

In this respect, it is to be noted that the machine frame 7 of the bending machine 3 is merely represented in a very simplified manner, it also being possible to use embodiments deviating from this. For example, the machine frame 7 or the machine body could be formed with a free upright passage. In this case the clamping jaw mounts 19, 20 could be mounted between the side walls 9, 10/side parts. In another embodiment of the machine frame 7/the machine body, it is not possible to have a free upright passage, whereby the clamping jaw mounts 19, 20 cannot be mounted between the side walls 9, 10/side parts.

For performing the bending operation, the bending machine 3 of the production installation 1 also comprises a bending unit 35, which may also be referred to as a bevel unit or forming unit. A possible design thereof is shown in a simplified form in FIG. 2 and may be adjusted relative to the machine frame 7 according to the bending operation to be performed. To provide a better overview, representation of the bending unit 35 and its components in FIG. 1 was abstained from.

The metal sheet which is prepositioned and held clamped between the two clamping jaws 5, 6 may be formed, in particular beveled, to form the workpiece 2 by means of a bending operation, in particular a beveling operation, along the bending line forming the bending region 34.

Depending on the beveling to be performed on the metal sheet clampingly held between the clamping jaws 5, 6 to manufacture the workpiece 2, either the lower clamping jaw 5 or the upper clamping jaw 6 forms the beveling region and thus the bending region 34. Thus, the lower clamping jaw 5 forms a first forming edge or comprises the latter. The upper clamping jaw 6 forms a second forming edge or comprises the latter.

The two clamping surfaces 30, 31 of the clamping jaws 5, 6 described above define a workpiece supporting plane 36 for the workpiece 2 to be manufactured in a position resting against one another. Preferably, the workpiece supporting plane 36, looked at in a vertical direction, is arranged at the same height as the support plane 33 defined by the support table 32. The two planes are preferably oriented extending plane-parallel to one another and can be arranged in a common plane.

The bending unit 35 may comprise one or multiple bending tool(s) 37, which can be arranged on a bending beam 38. The bending beam 38 can be adjusted relative to the machine frame 7 by means of a bending beam drive on bending beam guides not shown in further detail. However, it is also possible that merely one bending tool 37 is provided, which is pivotable about a tool pivot axis that is pivotable in parallel to the bending tool 34. Hence, depending on the desired bending direction, the bending tool 37 once can be arranged above the workpiece supporting plane 36 and once below the workpiece supporting plane 36 and in this regard the end of the bending tool 37 provided for bending can be aligned so as to point in the direction towards the bending tool in each case.

As described above, the upper clamping jaw segments 41 of the upper clamping jaw 6 can preferably be held clamped such that one of them can be removed from the current position by a schematically indicated tool-changing unit 39 and, either after moving or after displacing further upper clamping jaw segments 41 in the "Z" direction and thus in the direction of the longitudinal extension of the bending region 34 or the clamping beams 13, 16, can be inserted into the resulting free space or the gap, or can be inserted again at the edge and held clamped there again if necessary.

The tool-changing unit 39 is represented in a schematic manner in front of the upper clamping beam 16. It can be held on the upper clamping beam 16 or on the fixed machine frame 7, in particular on its side walls 9, 10. In the latter case, the upper clamping beam 16 must be moved to a predefined tool-changing position relative to the tool-changing unit 39 in order for the planned changing operation to be carried out. For this purpose, the clamp or clamps of the clamping jaw segments 41 to be changed and/or moved must be released or unlocked so that the removal and/or displacement motion of the upper clamping jaw segments 41 remaining on the clamping beam 16 can be carried out. The at least one removed upper clamping jaw segment 41 is preferably removed from the upper clamping beam 16 in the "X" direction after release of the clamp has been carried out and is placed at one of the positions described above.

In the illustration in FIG. 1 it is also indicated that the lower clamping jaw 5 can comprise multiple lower clamping jaw segments 40 designed to have the same width. The same applies to the upper clamping jaw 6, which can also comprise multiple upper clamping jaw segments 41 designed to have the same width. The width or thickness of the clamping jaw segments 40, 41 is looked at in the direction of the "Z" axis and thus in the direction of the longitudinal extension of the clamping beams 13, 16.

In order to be able to carry out an almost exact or completely exact adaptation of the bending length of the bending region 34 formed by the upper clamping jaw 6 to the workpiece 2 to be bent, at least one upper clamping jaw set 42 of multiple individual clamping jaws 43, 44, 45 and 46 is provided in addition to the upper clamping jaw segment(s) 41. Hence, a quantity or number "m" of individual clamping jaws 43, 44, 45 and 46 can for example amount to two, three or four items up to six, seven, eight and ten items.

Here, a specific example is shown with a number "m" of six individual clamping jaws 43, 44, 45 and 46. In this regard, each one of the individual, in particular upper, individual clamping jaws 43, 44, 45 and 46, which each have the same thickness or width, is also provided with the same reference number. This clamping jaw set 42 shown here by way of example comprises e.g. a first individual clamping jaw 43 having a thickness or width of 10 mm, a second individual clamping jaw 44 having a thickness or width of 15 mm, a third individual clamping jaw 45 having a thickness or width of 20 mm and three fourth individual clamping jaws 46 each having a thickness or width of 40 mm. Thus, in case of the presently selected number "m" of six individual clamping jaws 43, 44, 45 and 46 with the thicknesses or width in the direction of the "Z" axis indicated by way of example, a total bending length results from the sum of the respective thicknesses or widths. In the present exemplary embodiment, the six individual clamping jaws 43, 44, 45 and 46 form a bending length of 165 mm in a position in which they abut on one another.

In this context, it should be noted that the number and/or the division and quantity of individual clamping jaws 43, 44, 45 and 46 and/or their thicknesses or widths may also differ from these figures.

The holding and clamping of the individual clamping jaws 43, 44, 45 and 46 is carried out analogous to the upper clamping jaw segment(s) 41 according to the prior art at the upper clamping jaw mount 20. After release of the clamping retention or fixture, the upper clamping jaw segments 41 as well as the individual clamping jaws 43, 44, 45 and 46 can be moved or displaced in the direction of the longitudinal extension of the upper clamping jaw mount 20 by means of an adjusting unit not shown in further detail. Moreover, for adapting the active bending length, individual ones of the upper clamping jaw segments 41 and/or individual ones of the individual clamping jaws 43, 44, 45 and 46 can be removed from the upper clamping jaw mount 20 of the upper clamping beam 16 and either be inserted and held outside of the bending region and thus laterally on the upper clamping jaw mount 20 or be passed on to a tool storage.

The upper clamping jaw 6 can comprise at least one upper clamping jaw segment 41 and/or at least one of the individual clamping jaws 43, 44, 45, 46. FIGS. 1 to 4 show only the division and design of the upper clamping jaw 6 and the tool-changing unit 39 in more detail, while this division and design can also be provided analogously for the lower clamping jaw 5.

The individual clamping jaws 43, 44, 45, 46 also each have the clamping surfaces 30 and the forming edges 47 or bending edges extending in the "Z" direction at the edges. Moreover, a connecting section, which is arranged at a distance from the clamping surface 30 and faces the upper clamping beam 16, in particular its upper clamping jaw mount 20, is provided in each one of the individual clamping jaws 43, 44, 45, 46, wherein said connecting section can be designed according to the known prior art. The connecting section(s) serve(s) for clamping retention on the clamping beam 16 of the production plant 1.

The further detailed description of the design of the individual clamping jaws 43, 44, 45, 46 is provided after the description of the tool-changing unit 39, as is shown in detail in FIGS. 3 to 6 with its components or component assemblies.

By the formation of the tool-changing unit 39, setting of an active clamping length of a clamping tool, in particular a clamping jaw set 42 comprising multiple individual clamping jaws 43, 44, 45, 46 can be carried out easily. The tool-holding device 48 comprises a carrier body 49 as well as multiple tool-holding modules 50 arranged directly next to one another. The number of tool-holding modules 50 is indicated with "n" items and amounts to 16 (sixteen) in the present exemplary embodiment. The individual tool-holding modules 50 are arranged directly next to one another and held or mounted on the carrier body 49.

For the sake of clarity, the representation of drive or adjusting means for carrying out the relative displacement or adjustment of the tool-changing unit 39 in relation to the bending machine 3, in particular its upper clamping beam 16, has been dispensed with. These can for example be spindle drives, servomotors, cylinder-piston arrangements or the like. These drive or adjusting means can be driven by means of diverse drive energies and can carry out the displacement movements independently of separate displacement or adjusting means for carrying out the relative displacement movement of the upper clamping jaw 6 with its clamping jaw segments 41 and/or individual clamping jaws 43, 44, 45, 46. Hence, the changeover time for adapting the currently required length of the forming edge can be reduced considerably.

The tool-holding modules 50 either can be arranged or formed within a common base body 51 or each one of the tool-holding modules 50 can be arranged in a separate base body 51 designed in a plate-like shape and the base bodies 51 can be assembled to a common block.

If the tool-holding modules 50 are each formed from the individual plate-shaped base bodies 51, these have a circumferential contour formed essentially flat in profile. In this case, the thickness or strength of the tool-holding modules 50 is selected to be small and can for example amount to approx. 10 mm. The base body 51 is delimited by a first flat side 52, a second flat side 53, a first longitudinal end face 54, a second longitudinal end face 55, a first transverse end face 56 and a second transverse end face 57. The respective sides/faces may also be referred to as surfaces. The individual plate-shaped tool-holding modules 50 are each arranged to abut on one another on their flat sides 52, 53 that face one another. Moreover, the first transverse end face 56 faces the carrier body 49 here. For the sake of clarity, the illustration of fastening means between the base body 51 and the carrier body 49 has been dispensed with.

If the base body 51 is formed of a continuous whole piece, the tool-holding modules 50 are to be arranged therein at a predefined center-to-center distance with respect to one another, wherein, in this regard, the thicknesses or widths of the individual clamping jaws 43, 44, 45, 46 are to be taken into consideration.

Various other components or component assemblies, which are described in more detail below, are accommodated within the base body 51 or base bodies 51.

The tool-holding modules 50 of the tool-changing unit 39 serve for holding the previously described individual clamping jaws 43, 44, 45, 46 of the clamping jaw set 42 in a coupling position to change tools and for removing these after release of the clamping retention on the clamping beam 16 and inserting them again.

Here, it is provided that each one of the tool-holding modules (50) comprises a first coupling means (59) and a first actuating means (60) cooperating with the first coupling means (59) as a component of a coupling device (58). The respective first actuating means 60 serves for actuating or adjusting the first coupling means 59 so as to bring it into a coupling position and hence in coupling engagement with a further coupling means described below. The first actuating means 60 also serves for bringing the first coupling means 59 out of coupling engagement. The first coupling means 59 can be brought into coupling engagement or out of coupling engagement with at least one of the individual clamping jaws 43, 44, 45, 46 or all of them by means of the first actuating means 60.

In the present exemplary embodiment, the first coupling means 59 is arranged in the region of the first longitudinal end face 54 or the base body 51 in each tool-holding module 50.

Preferably, each one of the tool-holding modules 50 comprises a second coupling means 61 and a second actuating means 62 cooperating with the second coupling means 61. With respect to the first coupling means 59, the second coupling means 61 is arranged on the second longitudinal end face 55 of the base body 51 or the base bodies 51 opposite to the first coupling means 59. In the present exemplary embodiment, the coupling means 59, 61 are each formed by a coupling body 63 accommodated in the base body 51 and adjustable relative to the base body 51 or the base bodies 51. The coupling bodies 63 can for example be formed by spheres, rotational ellipsoids or cylinders.

However, it is also possible for the coupling means 59, 61 to be formed by electromagnets. The choice of material of the individual clamping jaws 43, 44, 45, 46 of the clamping jaw set 42 is to be taken into consideration.

In case of these coupling means 59, 61 on a mechanical basis with their actuating means 60, 62, merely one of the coupling means 59, 61 as well as 60, 62 is described in further detail, since these are generally formed equally and are arranged in a mirror inverted manner with respect to one another.

The actuating means 60, 62 each comprise an actuating piston 64, which are each accommodated in an actuating piston space 65 arranged in the base body 51 or in the base bodies 51. The actuating piston space 65 defines an axis of the actuating piston space 66, the longitudinal extension of which preferably extends to be oriented parallel with respect to the flat sides 52, 53. Since the longitudinal end faces 54 and 55 as well as the transverse end faces 56 and 57 are arranged in a perpendicular and/or rectangular alignment with respect to one another, the axis of the actuating piston space 66 also extends in parallel alignment with respect to the longitudinal end faces 54 and 55 or in a perpendicular or rectangular alignment with respect to the transverse end faces 56 and 57 the base body 51 or the base bodies 51. Each one of the actuating pistons 64 is mounted in the actuating piston space 65 so as to be guided in the direction of the axis of the actuating piston space 66. In the present case, the displacement motions of the actuating pistons 64 are carried out by means of a pressure medium, such as compressed air or a hydraulic fluid.

At least one first pressure medium line 67 and at least one second pressure medium line 68 are provided in the base body 51 or in each one of the base bodies 51 for pressurizing the actuating piston space 65 of each of the tool-holding modules 50. The pressure medium lines 67, 68 are each fluidically connected to one of the actuating piston spaces 65 and each open into the actuating piston space 65 on sides of the actuating piston 64 accommodated in the actuating piston space 65 facing away from one another. Depending on the pressurization of one of the pressure medium lines 67, 68, the actuating piston 64 can be adjusted either in the direction towards the second transverse end face 57 or in the direction towards the first transverse end face 56. Here, the first pressure medium line 67 are fluidically connected to the side of the actuating piston space 65 facing the carrier body 49, wherein the second pressure medium lines 68 open into the actuating piston space 65 on the side facing away therefrom.

The actuating pistons 64 each have at least one actuating surface 69 oriented so as to extend tilted with respect to the axis of the actuating piston space 66. The actuating surfaces 69 are provided and designed such that, in the event of a longitudinal adjustment of the actuating piston 64, they bring the coupling body 63 cooperating therewith and to be adjusted either into coupling engagement or out of coupling engagement. Preferably, the coupling bodies 63 are adjusted into the respective coupling engagement, wherein resetting can also be effected by gravity. This is the case for the presently first coupling body 63 of the coupling means 59 arranged on top. For the presently second coupling means 61, resetting is carried out by means of a relative movement between the base body 51 and one of the individual clamping jaws 43, 44, 45, 46. Each one of the coupling bodies 63 is supported so as to abut on the actuating surface 69 at least when the coupling body 63 is in coupling engagement. The actuating surface 69 can for example be designed in the form wedge surface. In this case, a rotation prevention and guide of the actuating piston 64 is to be provided so as to avoid rotational movements about the own axis and about the axis of the actuating piston space 66. Preferably, the actuating surfaces 69 are each formed as frustum surfaces.

Due to the longitudinal displacement of the actuating pistons 64 and the cooperation of the respective actuating surface 69 with the coupling body 63, each one of the coupling bodies 63 can be displaced from a coupling position projecting beyond the longitudinal end face 54, 55 into a release position located within the base body 51 or the base bodies 51. The resetting can only be enabled, but not necessarily effected by the actuating piston 64.

Moreover, at least one pressure piston 70 can be provided in each one of the tool-holding modules 50. The at least one pressure piston 70 is accommodated in a pressure piston space 71 accommodated in the base body 51 or the base bodies 51 and mounted so as to be guided in the direction of an axis of the pressure piston space 72 therein. Hence, the possibility of moving one of the individual clamping jaws 43, 44, 45, 46 held on the tool-changing unit 39 away from one or multiple ones of the tool-holding modules 50 is created. The pressure pistons 70 are each arranged such in the base body 51 or in the base bodies 51 that these can be adjusted from a pressure position projecting beyond the second transverse end face 57 into a rest position located within the base body 51 or the base bodies 51. The adjusting movement into the pressure position projecting beyond the second transverse end face 57 can be effected by means of a pressure medium. Resetting into the rest position located within the base body 51 can be effected by a mechanical contact with one of the individual clamping jaws 43, 44, 45, 46 of the clamping jaw set 42.

To pressurize the pressure piston space 71, it is provided here that a third pressure medium line 73 is arranged or formed in each one of the tool-holding modules 50. The third pressure medium line 73 is fluidically connected with the pressure piston space 71 on its side facing the first transverse end face 56 in each case. To allow for correct supply and discharge of the pressure medium to the actuating pistons 64 as well as the pressure piston 70 to be carried out, valve arrangements 74 are provided. In this regard, a separate valve arrangement 74 is provided for each one of the tool-holding modules 50. Here, a number "n" of tool-holding modules 50 is provided (preferably 16 items), while the same number "o" of valve arrangements 74 is present. Each one of the valve arrangements 74 comprises a first pressure medium connection 75 and a second pressure medium connection 76. In this regard, the first pressure medium connection 75 is fluidically connected to the first pressure medium line 67 and to the third pressure medium line 73 of the respective tool-holding module 50. The second pressure medium connection 76, in turn, is fluidically connected to the second pressure medium line 68 of the respective tool-holding module 50.

As described above, the coupling means 59, 61 formed by an electromagnet could be actuated by electric current as the actuating means 60.

Figure 3:
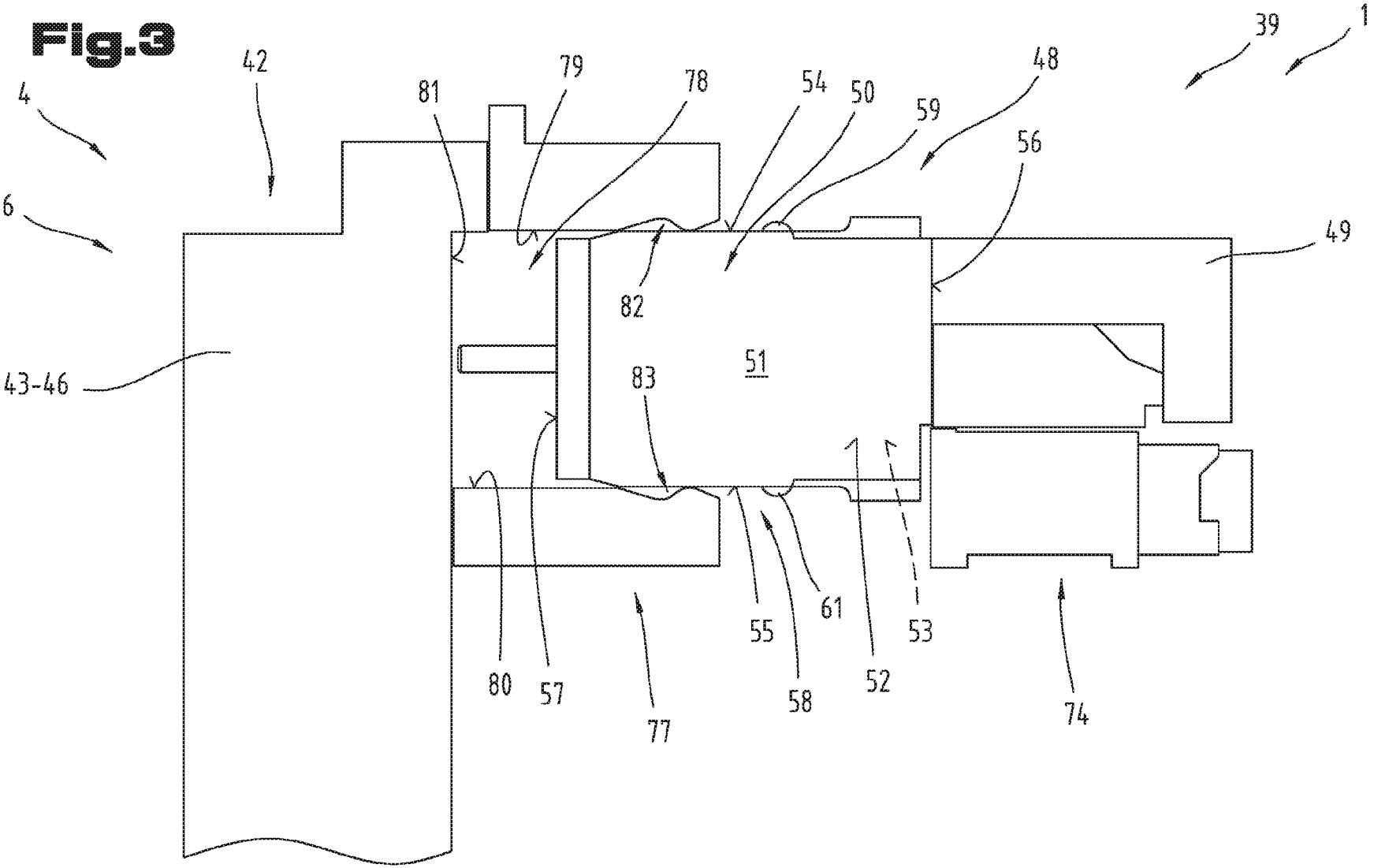
FIG. 3 a lateral view and stylized representation of the tool-changing unit as well as a section of an individual clamping jaw.
Figure 4:
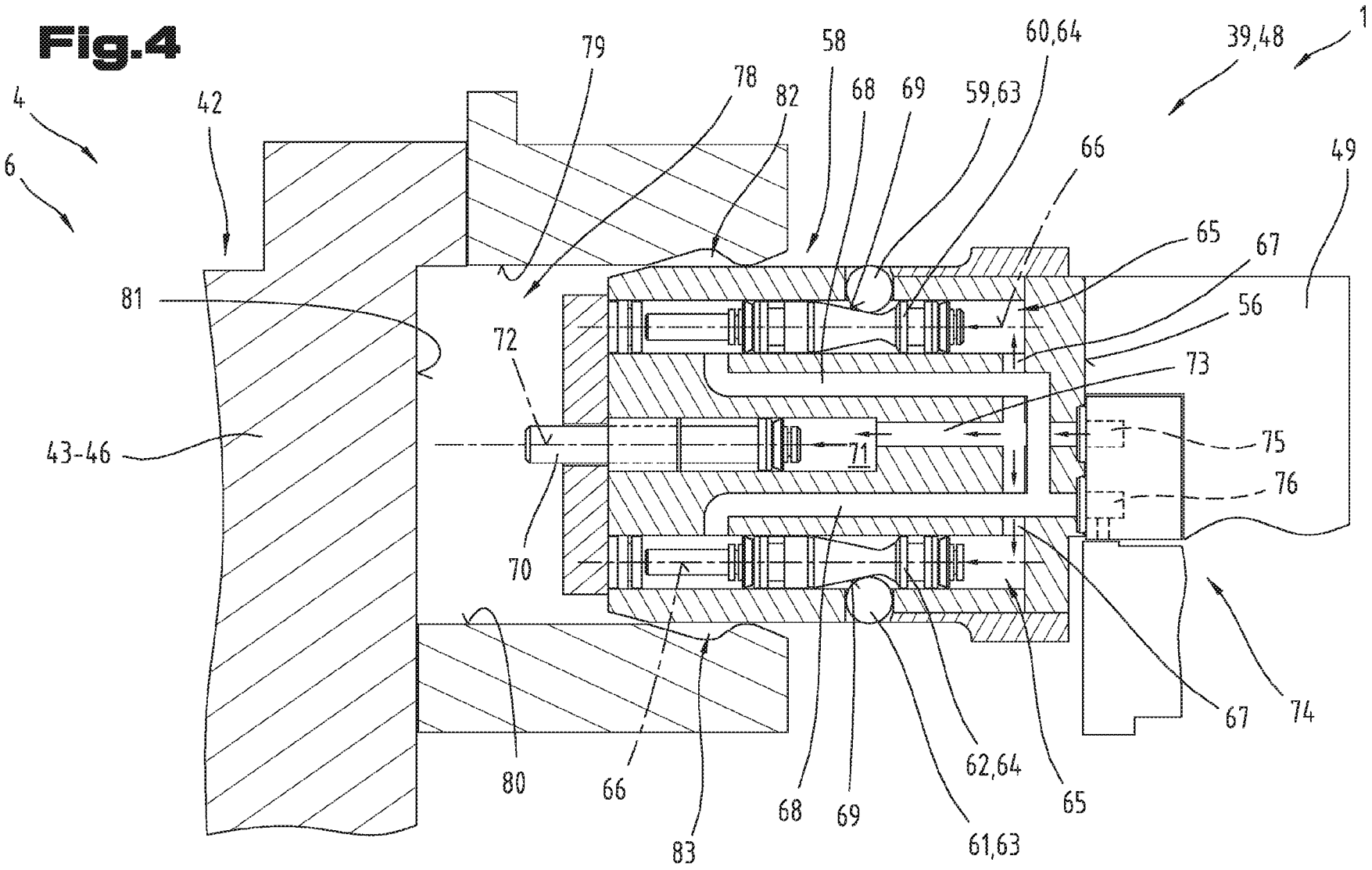
FIG. 4 a sectional side view of the tool-changing unit as well as a section of an individual clamping jaw according to FIG. 3 with the coupling device not yet being in coupling engagement.
Figure 5:
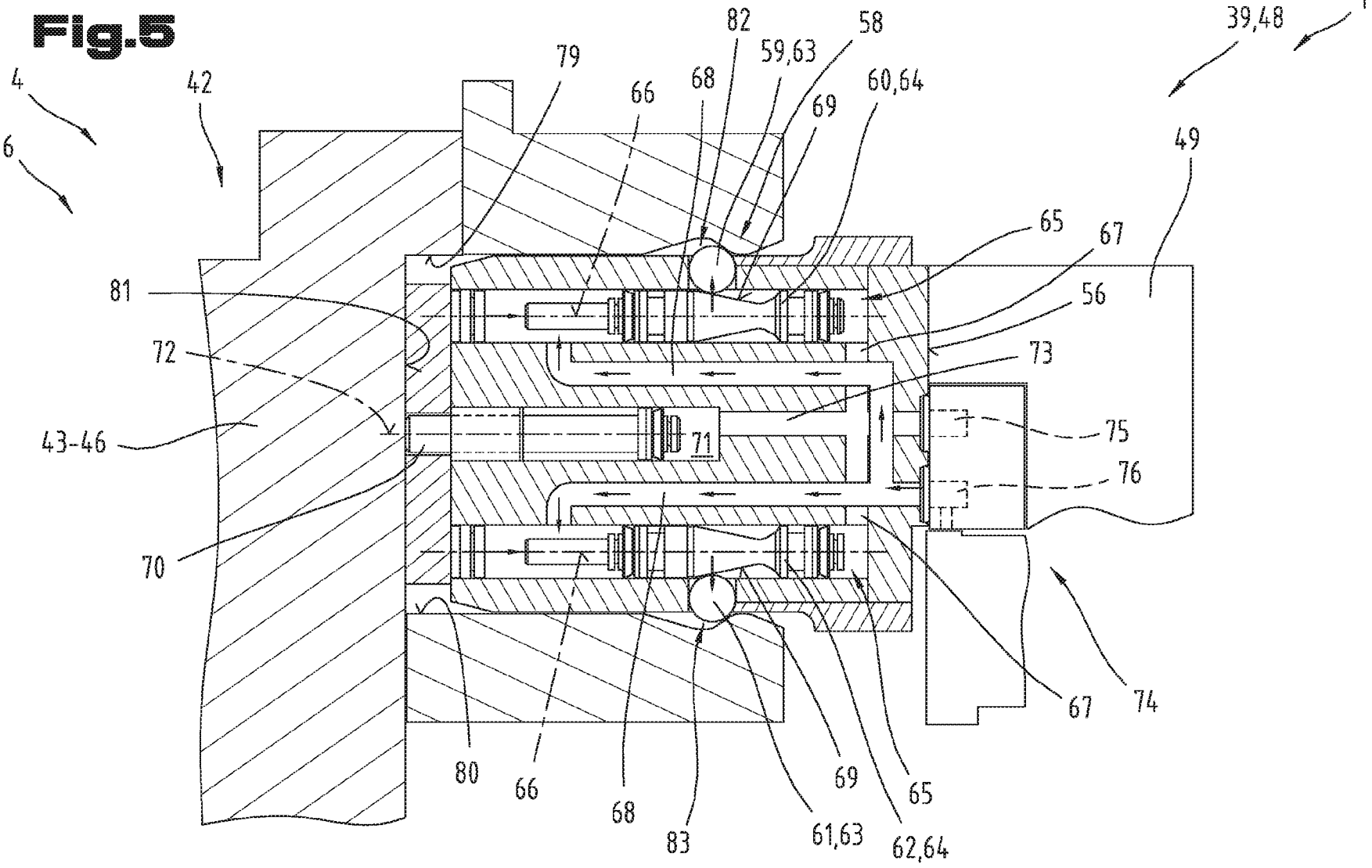
FIG. 5 a sectional side view of the tool-changing unit as well as a section of an individual clamping jaw according to FIGS. 3 and 4 with the coupling device being in coupling engagement.
Figure 6:
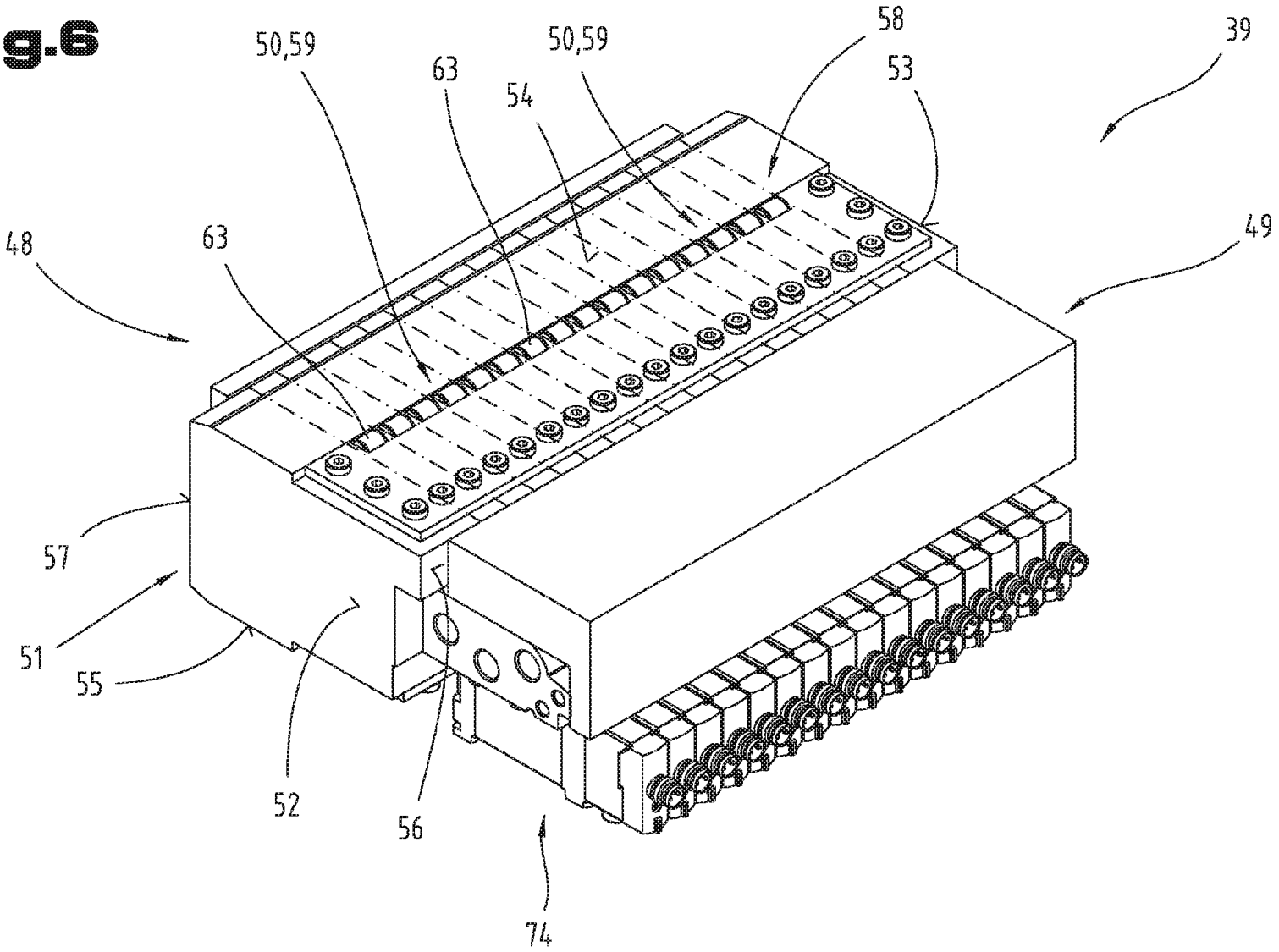
FIG. 6 a graphic representation of the tool-changing unit with a common base body.

To allow for the tool-holding modules 50 to be coupled to the individual clamping jaws 43, 44, 45, 46 of the clamping jaw set 42, each one of the individual clamping jaws 43, 44, 45, 46, 58 further comprises a coupling section 77 as a component of the coupling device, as can better be seen from FIGS. 3 to 5. Each one of the coupling sections 77 comprises a groove-shaped receiving opening 78, which is delimited by a first groove side face 79, a second groove side face 80 and a groove base surface 81. The groove side faces 79, 80 each extend in a perpendicular orientation with respect to the forming edge 47 towards the side facing away from the forming edge 47 as well as in a preferably parallel orientation with respect to the clamping surface 30. The groove-shaped receiving opening 78 with its groove side faces 79, 80 can in each case be formed by attachments in the shape of a flat profile on the respective individual clamping jaw 43, 44, 45, 46. Hence, already existing individual clamping jaws 43, 44, 45, 46 can also be retrofitted with the coupling sections 77.

The coupling device 58 further comprises a third coupling means 82 in the region of the individual clamping jaws 43, 44, 45, 46. The third coupling means 82 is arranged or formed in or on each one of the first groove side faces 79, and is further configured such that it can be brought into coupling engagement with a first coupling means 61 of a tool-holding module 50 of a tool-holding device 48.

Preferably, a fourth coupling means 83 is arranged or formed in or on each one of the second groove side faces 80. The third coupling means 82 and the fourth coupling means 83 are each formed by a V-shaped recess as viewed in cross-section of the groove-shaped receiving opening 78. Hence, after their adjustment into the coupling position, each one of the coupling bodies 63 can engage in the respectively provided V-shaped recess and rest against one of the recess walls. Since, in the coupling position, each one of the coupling bodies 63 rests against that recess wall which is tapered and tilted in the direction facing away from the respective individual clamping jaw 43, 44, 45, 46, each one of the base bodies 51 of the tool-holding modules 50 is pressed against the groove base surface 81 with its second transverse end face 57.

In order to facilitate the inserting motion of the base bodies 51 of the tool-holding modules 50 into the receiving opening 78 and to also facilitate a possible resetting of at least one of the coupling bodies 63 into its position located within the base body 51, the groove side faces 79, 80 can each be provided with an inlet chamfer on their end sections facing away from the groove base surface 81.

With the tool-changing unit 39 described above and the clamping jaw 5, 6, in particular the upper clamping jaw 6, comprising at least one upper clamping jaw segment 41 and at least one clamping jaw set 42 of multiple individual clamping jaws 43, 44, 45, 46, the production plant 1 described above comprises.

Depending on the choice and formation of the individual clamping jaws 43, 44, 45, 46 in their total number "m", these have a total thickness in the direction of their forming edge 47. For example, in case of the choice described above, it amounts to 165 mm. The total thickness of the individual clamping jaws 43, 44, 45, 46 essentially corresponds to a construction length of the tool-holding modules 50 in their number "n" arranged next to one another. When the total thickness of the individual clamping jaws 43, 44, 45, 46 is divided by the number "n"—in the present exemplary embodiment 16 items—the plate-shaped base bodies 51 have a thickness of 10.3 mm. Preferably, the thickness or strength is selected to be 10.5 mm. Hence, all individual clamping jaws 43, 44, 45, 46 or just individual ones of these can be picked up by means of the tool-changing unit 39 and its tool-holding modules 50 and held coupled thereon.

Where a common base body 51 is provided, a spacing between the tool-holding modules 50 with their coupling bodies 63 must be selected in the same way as indicated above. The spacing refers to the respective means of the tool-holding modules 50, in particular their coupling bodies 63. The common base body 51 could also project laterally beyond the first tool-holding module 50 and/or laterally beyond the last tool-holding module 50 in each case. In this case, observance of the spacing between the respective means of the tool-holding modules 50 is essential.

For changing tools of at least one of the individual clamping jaws 43, 44, 45, 46 of the clamping jaw set 42 in a production plant 1 described above, at least the tool-changing unit 39 as well as the clamping jaw set 42 according to the description above are to be provided. For adapting the required bending length, the individual partial lengths of the forming edges 47 formed by the clamping jaw set 42 and, if applicable, also by the at least one upper clamping jaw segment 41 located thereon are to be adapted accordingly by changing them. In order to do this, the tool-changing unit 39, along with its tool-holding modules 50, is inserted into the receiving openings 78 of the individual clamping jaws. In case of the clamping jaw set 42 not being present in its entirety on the upper clamping beam 16, upper clamping jaw segments 41 located laterally adjacent to the individual clamping jaws 43, 44, 45, 46 are to be moved, if necessary.

Since the coupling sections of the individual clamping jaws 43, 44, 45, 46 project beyond the individual clamping jaws 43, 44, 45, 46 preferably in the direction toward the feed side, this alone already serves to avoid collisions with the tool-changing unit 39.

After inserting the tool-holding modules 50 into the receiving openings 78, at least one of the actuating means 60 and, if necessary, also the second actuating means 62 of the same tool-holding module 50, should this be provided, is activated, and the coupling means 59 as well as, if necessary, 61 is adjusted into the coupling position and hence brought into coupling engagement with the selected individual clamping jaws 43, 44, 45, 46. Then, the clamping retention of the upper clamping jaw 6 is released. Subsequently, the individual clamping jaw(s) 43, 44, 45, 46 held coupled on the tool-changing unit 39 can be removed from the upper clamping beam 16, in particular its clamping jaw mounts 20, and moved into the position intended therefor. After the removal of the at least one individual clamping jaw 43, 44, 45, 46, the at least one upper clamping jaw segment 41 possibly remaining on the upper clamping beam 16 and the remaining individual clamping jaw(s) 43, 44, 45, 46 are adjusted into a position where they abut on one another by means of an adjusting unit. The at least one individual clamping jaw 43, 44, 45, 46 removed from the upper clamping beam 16 by the tool-changing unit 39 is either inserted and held outside the bending region and thus laterally on the upper clamping beam 16 in its clamping jaw mount 20, or is passed on to a tool storage.

Figure 7:
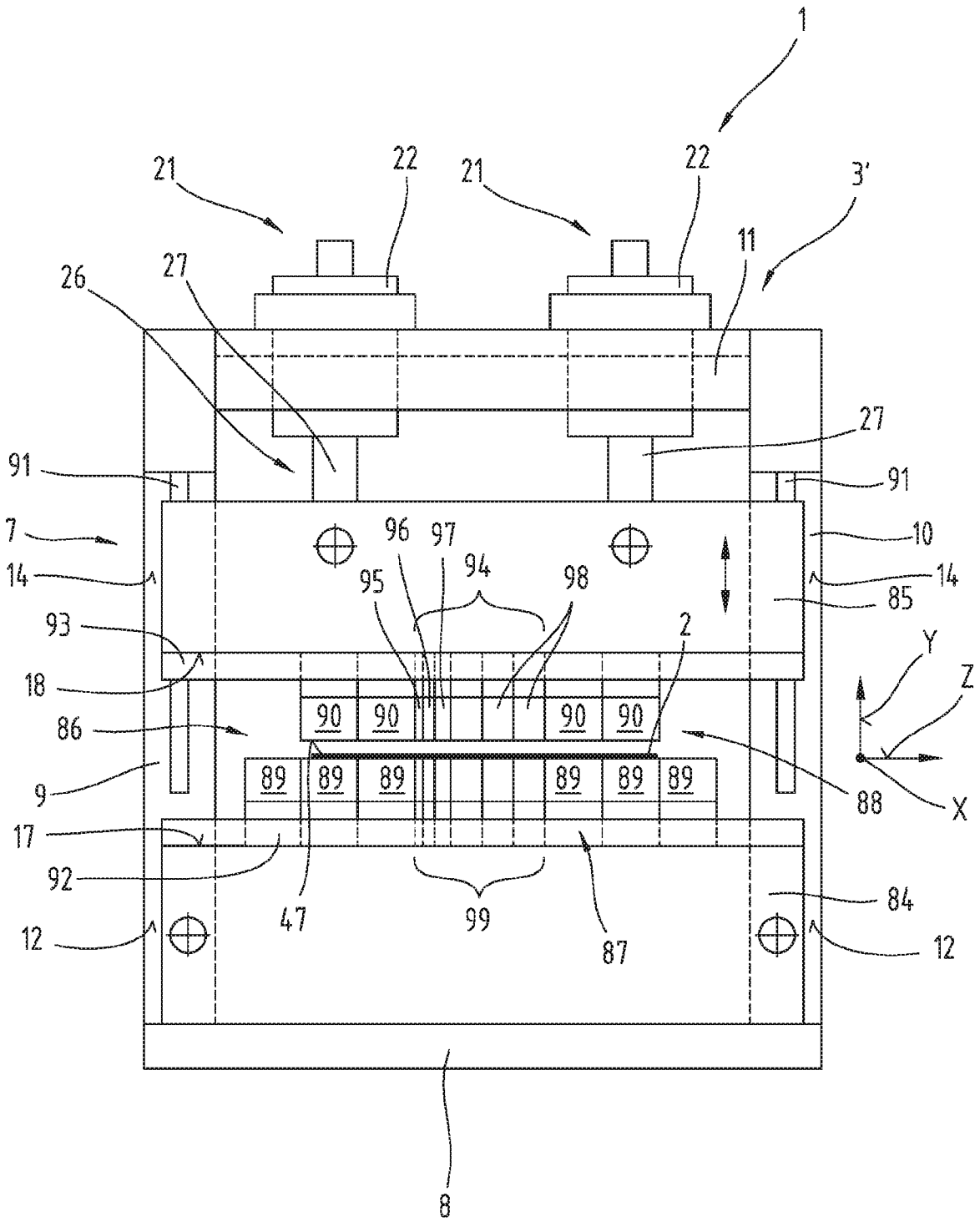
FIG. 7 a view of a further possible, and optionally independent possibility of use of the tool-changing unit in a production plant for air bending or bottom bending of a workpiece to be produced from a sheet metal.

FIG. 7 shows possible, and optionally independent possibility of use of the tool-changing unit 39 described above in a production plant 1 for air bending or bottom bending. In this exemplary embodiment, the bending machine 3' now comprises a lower or first press beam 84 and an upper or second press beam 85 instead of the previously described clamping beams 13, 16 and the clamping jaws 5, 6 held therein. Here, a bending tool 86 comprising at least one bending die 87 and at least one bending punch 88 cooperating therewith is arranged on both of the press beams 84, 85. The bending die 87 and/or the bending punch 88 is/are each preferably assembled from multiple individual components, analogously to how it has been described above.

The general structure of the bending machine 3' is equal to that of the previously described bending machine 3, however, no bending unit 35 is provided. In this regard, the at least one bending punch 88 is arranged on the bending press 3' above the workpiece 2 to be manufactured, and is held, in particular clamped, there accordingly. The at least one bending die 87 is also held, in particular held clamped, on the bending press 3'. The coordinate system is selected as previously described. However, the arrangement of the at least one bending punch 88 and the at least one bending die 87 can also be selected in deviance from the previously described arrangement. For instance, the at least one bending punch 88 could be arranged on the lower or first press beam 84 and the at least one bending die 87 could be arranged on the upper or second press beam 85.

The bending die 87 can preferably comprise multiple lower bending die segments 89, which analogously correspond to the previously described clamping jaw segments 40. The bending punch 88 can also comprise multiple upper bending punch segments 90, which analogously correspond to the previously described clamping jaw segments 41.

The machine frame 7 of the bending machine 3', in turn, comprises, for example, the side walls 9, 10 vertically rising from a base plate 8, having a distance from one another and being arranged in parallel to one another, which are connected to a frame from the cross connection 11 with each other. On the side walls 9, 10, the upper or second press beam 85 is guided displaceably on separate press beam guides 91. On end faces 17, 18 opposing one another and extending in parallel to one another of the two press beams 84, 85, a lower tool holder 92 and an upper tool holder 93 may be arranged in each case. By means of the driving arrangement 21 and the previously described controller 24 and the input terminal 25, for example, the operation of the bending machine 3' can be carried out and controlled.

In this bending machine 3', the bending operation of the workpiece 2 to be produced is carried out directly by means of the bending tool 86 and its components. To allow for customized adaption of the active length of the bending tool 86, in particular of the bending punch(es) 88 in combination with the bending punch segment 90 or the bending punch segments 90 to be carried out also for this type of the bending machine 3', the tool-changing unit 39 described above can be used here as well.

In order to be able to carry out an almost exact or completely exact adaptation of the bending length formed or defined by the bending punch 88 to the workpiece 2 to be bent, at least one upper bending punch set 94, which generally corresponds to the clamping jaw set 42 described above, is provided in addition to the upper bending punch segment(s) 90. The bending punch set 94, in turn, comprises multiple individual bending punches 95, 96, 97 and 98. Hence, a quantity or number "m" of individual bending punches 95, 96, 97 and 98 can for example amount to two, three or four items up to six, seven, eight and ten items.

As a specific example, here as well, a number "m" of six individual bending punches 95, 96, 97 and 98 is selected and shown. In this regard, each one of the individual, in particular upper, individual bending punches 95, 96, 97 and 98, which each have the same thickness or width, is also provided with the same reference number. This bending punch set 94 shown here by way of example comprises e.g. a first individual bending punch 95 having a thickness or width of 10 mm, a second individual bending punch 96 having a thickness or width of 15 mm, a third individual bending punch 97 having a thickness or width of 20 mm and three fourth individual bending punches 98 each having a thickness or width of 40 mm. Thus, in case of the presently selected number "m" of six individual bending punches 95, 96, 97 and 98 with the thicknesses or width in the direction of the "Z" axis indicated by way of example, a total bending length results from the sum of the respective thicknesses or widths. In the present exemplary embodiment, the six individual bending punches 95, 96, 97 and 98 form a total bending length of 165 mm in a position in which they abut on one another.

In this context, it should be noted that the number and/or the division and quantity of individual bending punches 95, 96, 97 and 98 and/or their thicknesses or widths may also differ from these figures.

By means of the tool-changing unit 39, which is not described in further detail here, not only the bending punch (es) 88, in particular the bending punch segments (90) and the individual bending punches 95, 96, 97 and 98, but also the bending die 87 and its components can be adapted to the required bending length. For this purpose, the bending die 87 can comprise not only the bending die segments 89, but additionally, analogous to the bending punch set 94, a separate bending die set 99 of its own, which is only indicated by way of example and comprises multiple individual dies that are not described in further detail.

Each one of the bending punches 88, in particular the bending punch segments 90 as well as the individual bending punches 95, 96, 97 and 98 form a forming edge 47 or a bending edge, which cooperates with the bending die 87 in known manner, on their end facing the workpiece 2.

The formation and arrangement of the coupling means and/or the coupling sections 77, as a component of the coupling device 58, on the individual bending punches 95, 96, 97 and 98 and/or the individual dies can be carried out analogously, as was described in detail above with regard to the individual clamping jaws 43, 44, 45, 46. In order to avoid unnecessary repetitions, reference is made to the above description and it is omitted here.

This is to express that the tool-changing unit 39 can not only be used for swivel bending, but also in a bending machine 3', which is designed for air bending, die bending or bottom bending. The method steps to be carried out in order to change tools are indicated below:

providing the bending machine 3' having the fixed machine frame 7, a lower press beam 84 and an upper press beam 85, wherein one of the press beams 84, 85 can be adjusted relative to the machine frame 7, providing a tool-changing unit 39 having a tool-holding device 48, said tool-holding device 48 comprising a carrier body 49 as well as a number "n" of tool-holding modules 50 arranged directly next to one another, and the tool-holding modules 50 are held on the carrier body 49, forming each one of the tool-holding modules 50 so as to have a first coupling means 59 and a first actuating means 60 cooperating with the first coupling means 59 as a component of a coupling device 58, providing the bending tool 86 having the bending die 87 and the bending punch 88, wherein the bending die 87 is held releasably clamped on the lower press beam 84 and the bending punch 88 is held releasably clamped on the upper press beam 85, to allow for the bending operation to be carried out on the workpiece 2 to be produced, providing at least one bending punch segment 90 and at least one bending punch set 94 comprising multiple individual bending punches 95, 96, 97, 98 to form the bending punch 88, forming the individual bending punches 95, 96, 97, 98 to each have a forming edge 47 and a connecting section arranged at a distance therefrom, wherein the forming edge 47 can be turned towards the workpiece 2 to be formed and the connecting section is held releasably clamped on the upper press beam 85, forming the individual bending punches 95, 96, 97, 98 to each have a coupling section 77 as a component of a coupling device 58, wherein each coupling section 77 delimits a groove-shaped receiving opening 78 with a first groove side face 79, a second groove side face 80 and a groove base surface 81, forming the third coupling means 82 in or on each one of the first groove side faces 79, inserting the tool-holding modules 50 of the tool-changing unit into the groove-shaped receiving openings 78 of the individual bending punches 95, 96, 97, 98, adjusting or activating at least one selected first actuating means 60, wherein in the course of this, the first coupling means 59 of the tool-holding module 50 associated with the first actuating means 60 is brought into coupling engagement with the third coupling means 82 of an individual bending punch 95, 96, 97, 98, releasing the clamping retention of the bending punch 88, displacing the tool-changing unit 39 along with the at least one individual bending punch 95, 96, 97, 98 held coupled thereon.

The exemplary embodiments show possible embodiment variants, and it should be noted in this respect that the invention is not restricted to these particular illustrated embodiment variants of it, but that rather also various combinations of the individual embodiment variants are possible and that this possibility of variation owing to the teaching for technical action provided by the present invention lies within the ability of the person skilled in the art in this technical field.

The scope of protection is determined by the claims. However, the description and the drawings are to be adduced for construing the claims. Individual features or feature combinations from the different exemplary embodiments shown and described may represent independent inventive solutions. The object underlying the independent inventive solutions may be gathered from the description.

All indications regarding ranges of values in the present description are to be understood such that these also comprise random and all partial ranges from it, for example, the indication 1 to 10 is to be understood such that it comprises all partial ranges based on the lower limit 1 and the upper limit 10, i.e. all partial ranges start with a lower limit of 1 or larger and end with an upper limit of 10 or less, for example 1 through 1.7, or 3.2 through 8.1, or 5.5 through 10.

Finally, as a matter of form, it should be noted that for ease of understanding of the structure, elements are partially not depicted to scale and/or are enlarged and/or are reduced in size.

LIST OF REFERENCE NUMBERS

| | |
|---|---|
| 1 | production plant |
| 2 | workpiece |
| 3 | bending machine |
| 4 | clamping tool |
| 5 | lower clamping jaw |
| 6 | upper clamping jaw |
| 7 | machine frame |
| 8 | base plate |
| 9 | side wall |
| 10 | side wall |
| 11 | cross connection |
| 12 | front end face |
| 13 | lower clamping beam |
| 14 | front end face |
| 15 | clamping beam guide |
| 16 | upper clamping beam |
| 17 | lower end face |
| 18 | upper end face |
| 19 | lower clamping jaw mount |
| 20 | upper clamping jaw mount |
| 21 | driving arrangement |
| 22 | driving means |
| 23 | energy grid |
| 24 | controller |
| 25 | input terminal |
| 26 | spindle drive |
| 27 | adjusting means |
| 28 | adjusting plane |
| 29 | clamping region |
| 30 | lower clamping surface |
| 31 | upper clamping surface |
| 32 | support table |
| 33 | support plane |
| 34 | bending region |
| 35 | bending unit |
| 36 | workpiece supporting plane |
| 37 | bending tool |
| 38 | bending beam |
| 39 | tool-changing unit |
| 40 | lower clamping jaw segment |
| 41 | upper clamping jaw segment |
| 42 | clamping jaw set |
| 43 | first individual clamping jaw |
| 44 | second individual clamping jaw |
| 45 | third individual clamping jaw |
| 46 | fourth individual clamping jaw |
| 47 | forming edge |
| 48 | tool-holding device |
| 49 | carrier body |
| 50 | tool-holding module |
| 51 | base body |
| 52 | first flat side |
| 53 | second flat side |
| 54 | first longitudinal end face |
| 55 | second longitudinal end face |
| 56 | first transverse end face |
| 57 | second transverse end face |
| 58 | coupling device |
| 59 | first coupling means |
| 60 | first actuating means |
| 61 | second coupling means |
| 62 | second actuating means |
| 63 | coupling body |
| 64 | actuating piston |

-continued

| | |
|---|---|
| 65 | actuating piston space |
| 66 | axis of the actuating piston space |
| 67 | first pressure medium line |
| 68 | second pressure medium line |
| 69 | actuating surface |
| 70 | pressure piston |
| 71 | pressure piston space |
| 72 | axis of the pressure piston space |
| 73 | third pressure medium line |
| 74 | valve arrangement |
| 75 | first pressure medium connection |
| 76 | second pressure medium connection |
| 77 | coupling section |
| 78 | receiving opening |
| 79 | first groove side face |
| 80 | second groove side face |
| 81 | groove base surface |
| 82 | third coupling means |
| 83 | fourth coupling means |
| 84 | lower press beam |
| 85 | upper press beam |
| 86 | bending tool |
| 87 | bending die |
| 88 | bending punch |
| 89 | bending die segment |
| 90 | bending punch segment |
| 91 | press beam guide |
| 92 | lower tool holder |
| 93 | upper tool holder |
| 94 | bending punch set |
| 95 | first individual bending punch |
| 96 | second individual bending punch |
| 97 | third individual bending punch |
| 98 | fourth individual bending punch |
| 99 | bending die set |

The invention claimed is:

1. A tool-changing unit (39) for a production plant (1) for producing workpieces (2) from sheet metal, the tool-changing unit (39) comprising:

a tool-holding device (48) comprising a carrier body (49) and a number "n" of tool-holding modules (50) arranged directly next to one another, and each one of the tool-holding modules (50) is held on the carrier body (49);

wherein each tool-holding module comprises a first coupling means (59) as a component of a coupling device (58), wherein the first coupling means (59) can be brought into coupling engagement or out of coupling engagement with one of the individual clamping jaws; and wherein each tool-holding module (50) comprises a first actuating means (60) cooperating with the first coupling means (59), wherein the first coupling means (59) can be brought into coupling engagement or out of coupling engagement with one of the individual clamping jaws (43, 44, 45, 46) by means of the first actuating means (60), wherein the first coupling means (59) is formed by a first coupling body (63) accommodated in a base body (51) and adjustable relative to the base body (51), wherein the first coupling body (63) is formed by a sphere, a rotational ellipsoid, or a cylinder, or wherein the first coupling means (51) is formed by an electromagnet.

2. The tool-changing unit (39) according to claim 1, wherein the tool-holding modules (50) are arranged in a common base body (51) and the base body (51) is delimited by a first longitudinal end face (54) and a second longitudinal end face (55) and by a first transverse end face (56) and a second transverse end face (57) and the base body (51) is held on the carrier body (49).

3. The tool-changing unit (39) according to claim 1, wherein the tool-holding modules (50) each comprise a base body (51) having a circumferential contour formed essentially flat in profile, wherein each base body (51) is delimited by a first flat side (52) and a second flat side (53), by a first longitudinal end face (54) and a second longitudinal end face (55) and by a first transverse end face (56) and a second transverse end face (57), and the tool-holding modules (50) abut on one another on the flat sides (52, 53) facing one another in each case and the first transverse end face (56) faces the carrier body (49) and each base body (51) is held on the carrier body (49).

4. The tool-changing unit (39) according to claim 2, wherein the first coupling means (59) are arranged in the region of the first longitudinal end face (54) of the base body (51) or the base bodies (51) of the tool-holding modules (50).

5. The tool-changing unit (39) according to claim 1, wherein the tool-holding modules (50) each comprise a second coupling means (61) and a second actuating means (62) cooperating with the second coupling means (61) and wherein, with respect to the first coupling means (59), the second coupling means (61) is arranged on the second longitudinal end face (55) of the base body (51) or the base bodies (51) opposite to the first coupling means (59).

6. The tool-changing unit (39) according to claim 1, wherein a second coupling means (61) is formed by a second coupling body (63) accommodated in the base body (51) and adjustable relative to the base body (51) or wherein the second coupling means (61) is formed by an electromagnet.

7. The tool-changing unit (39) according to claim 6, wherein the actuating means (60) are formed by electric current.

8. The tool-changing unit (39) according to claim 6, wherein each coupling body (63) is formed by a sphere, a rotational ellipsoid, or a cylinder.

9. The tool-changing unit (39) according to claim 6, wherein each one of the coupling bodies (63) can be displaced from a coupling position projecting beyond the longitudinal end face (54, 55) into a release position located within the base body (51) or the base bodies (51) by means of the actuating piston (64) cooperating with the coupling body (63).

10. The tool-changing unit (39) according to claim 9, wherein the pressure pistons (70) are each arranged such in the base body (51) or in the base bodies (51) that these can be adjusted from a pressure position projecting beyond the second transverse end face (57) into a rest position located within the base body (51) or the base bodies (51).

11. The tool-changing unit (39) according to claim 2, wherein the actuating means (60, 62) in each case comprise an actuating piston (64), and the actuating pistons (64) are each accommodated in an actuating piston space (65) arranged in the base body (51) and, therein, these are mounted so as to be guided in the direction of an axis of the actuating piston space (66).

12. The tool-changing unit (39) according to claim 2, wherein at least one first pressure medium line (67) and at least one second pressure medium line (68) are provided in the base body (51) and the pressure medium line (67) is in each case fluidically connected to the actuating piston space (65), and the first and second pressure medium lines (67, 68) each open into the actuating piston space (65) on sides of the actuating piston (64) accommodated in the actuating piston space (65) facing away from one another.

13. The tool-changing unit (39) according to claim 11, wherein the actuating pistons (64) each have at least one actuating surface (69) aligned so as to extend tilted with respect to the axis of the actuating piston space (66), on which actuating surface (69), in each case, one of the coupling bodies (63) is supported so as to abut thereon at least when the coupling body (63) is in coupling engagement.

14. The tool-changing unit (39) according to claim 13, wherein the actuating surfaces (69) are each formed as a frustum surface.

15. The tool-changing unit (39) according to claim 1, wherein at least one pressure piston (70) is provided in each one of the tool-holding modules (50), said at least one pressure piston (70) being accommodated in a pressure piston space (71) arranged in the base body (51) or in the base bodies (51) and being mounted so as to be guided therein in the direction of an axis of the pressure piston space (72).

16. The tool-changing unit (39) according to claim 1, wherein a third pressure medium line (73) is provided in each one of the tool-holding modules (50) and, in each case, the third pressure medium line (73) is fluidically connected to the pressure piston space (71) on its side facing the first transverse end face (56).

17. The tool-changing unit (39) according to claim 1, wherein a number "o" of valve arrangements (74), which is equal to the number "n" of tool-holding modules (50), each having at least one first pressure medium connection (75) and one second pressure medium connection (76) for each one of the tool-holding modules (50) is provided, and, in each case, the first pressure medium line (67) and the third pressure medium line (73) are jointly fluidically connected to the first pressure medium connection (75) and, in each case, the second pressure medium line (68) is fluidically connected to the second pressure medium connection (76).

18. A production plant (1) for producing workpieces (2) from sheet metal, comprising a bending machine (3) having a fixed machine frame (7), a lower clamping beam (13) and an upper clamping beam (16), wherein one of the clamping beams (13, 16) is adjustable relative to the machine frame (7), a bending unit (35), a clamping tool (4) having a lower clamping jaw (5) and an upper clamping jaw (6), wherein the lower clamping jaw (5) is held releasably clamped on the lower clamping beam (13) and the upper clamping jaw (6) is held releasably clamped on the upper clamping beam (16) in order to hold the workpiece (2) to be produced clamped between the two clamping jaws (5, 6) at least during the bending operation, and wherein at least the upper clamping jaw (6) comprises at least one upper clamping jaw segment (41) and at least one clamping jaw set (42) of multiple individual clamping jaws (43, 44, 45, 46) in a total number "m", wherein one clamping surface (30) each with a forming edge (47) is defined by the at least one upper clamping jaw segment (41) and the individual clamping jaws (43, 44, 45, 46), and each of said clamping surfaces (30) has a connecting section arranged at a distance therefrom, and wherein the clamping surfaces (30) can be turned towards the workpiece (2) to be clamped and the connecting section serves for clamping retention on a clamping beam (13, 16) of the production plant (1), wherein each one of the individual clamping jaws (43, 44, 45, 46), as a component of a coupling device (58), further comprises one coupling section (77), wherein the coupling section (77) delimits a groove-shaped receiving opening (78) with a first groove side face (79), a second groove side face (80) and a groove base surface (81), wherein the groove side faces (79, 80) each extend, in a perpendicular alignment with respect to the forming edge (47) as well as in a preferably parallel alignment with respect to the clamping surface (30), to the side facing away from the forming edge (47), and wherein a third coupling means (82) is arranged or formed in or on each one of the first groove side faces (79), said third coupling means (82) being configured such that it can be brought into coupling engagement with a first coupling means (61) of a tool-holding module (50) of a tool-holding device (48)

a tool-changing unit (39), wherein the tool-changing unit (39) is configured according to claim 1.

19. The production plant according to claim 18, wherein a total thickness of the individual clamping jaws (43, 44, 45, 46) in their total number "m" in the direction of their forming edge (47) essentially corresponds to a construction length of the tool-holding modules (50) arranged next to one another in their number "n".

20. The production plant according to claim 18, wherein a fourth coupling means (83) is arranged or formed in or on each one of the second groove side faces (80).

21. The production plant according to claim 18, wherein the third and/or fourth coupling means (82, 83) are each formed by a V-shaped recess as viewed in cross-section of the groove-shaped receiving opening (78).

22. The production plant according to claim 18, wherein the groove side faces (79, 80) are each provided with an inlet chamfer on their end sections facing away from the groove base face (81).

23. A method for changing tools in a production plant (1) for producing workpieces (2) from sheet metal, using the tool-changing unit (39) according to claim 1, the method comprising the following steps:

providing a bending machine (3) having a fixed machine frame (7), a lower clamping beam (13) and an upper clamping beam (16), wherein one of the clamping beams (13, 16) can be adjusted relative to the machine frame (7), providing a bending unit (35), providing a tool-changing unit (39) having a tool-holding device (48), said tool-holding device (48) comprising a carrier body (49) as well as a number "n" of tool-holding modules (50) arranged directly next to one another, and the tool-holding modules (50) are held on the carrier body (49), forming each one of the tool-holding modules (50) so as to have a first coupling means (59) and a first actuating means (60) cooperating with the first coupling means (59) as a component of a coupling device (58), providing a clamping tool (4) having a lower clamping jaw (5) and an upper clamping jaw (6), wherein the lower clamping jaw (5) is held releasably clamped on the lower clamping beam (13) and the upper clamping jaw (6) is held releasably clamped on the upper clamping beam (16) in order to hold the workpiece (2) to be produced clamped between the two clamping jaws (5, 6) at least during the bending operation, providing at least one upper clamping jaw segment (41) and at least one clamping jaw set (42) of multiple individual clamping jaws (43, 44, 45, 46) to form the upper clamping jaw (6), forming the individual clamping jaws (43, 44, 45, 46) to each have a clamping surface (30) with a forming edge (47) and a connecting section arranged at a distance therefrom, wherein the clamping surface (30) can be turned towards the workpiece (2) to be clamped and the connecting section is held releasably clamped on the upper clamping beam (16), forming the individual clamping jaws (43, 44, 45, 46) to each have a coupling section (77) as a component of a coupling device (58), wherein each coupling section (77) delimits a groove-shaped receiving opening (78) with a first groove side face (79), a second groove side face (80) and a groove base surface (81), forming a third coupling means (82) in or on each one of the first groove side faces (79), inserting the tool-holding modules (50) of the tool-changing unit (39) into the groove-shaped receiving openings (78) of the individual clamping jaws (43, 44, 45, 46), adjusting or activating at least one selected first actuating means (60), wherein in the course of this, the first coupling means (59) of the tool-holding module (50) associated with the first actuating means (60) is brought into coupling engagement with the third coupling means (82) of an individual clamping jaw (43, 44, 45, 46), releasing the clamping retention of the upper clamping jaw (6), displacing the tool-changing unit (39) along with the at least one individual clamping jaw (43, 44, 45, 46) held coupled thereon.

24. The method according to claim 23, wherein after the removal of the at least one individual clamping jaw (43, 44, 45, 46), the at least one upper clamping jaw segment (41) remaining on the upper clamping beam (16) and the remaining individual clamping jaw(s) (43, 44, 45, 46) are adjusted into a position where that abut on one another by means of an adjusting unit.

25. The method according to claim 23, wherein the at least one individual clamping jaw (43, 44, 45, 46) removed from the upper clamping beam (16) by the tool-changing unit (39) are either inserted and held outside the bending region and thus laterally on the upper clamping beam (16) or are passed on to a tool storage.

26. The method for changing tools in a production plant (1) for producing workpieces (2) from sheet metal using a tool-changing unit (39) according to claim 1, the method comprising the following steps:

providing a bending machine (3') having a fixed machine frame (7), a lower press beam (84) and an upper press beam (85), wherein one of the press beams (84, 85) can be adjusted relative to the machine frame (7), providing a tool-changing unit (39) having a tool-holding device (48), said tool-holding device (48) comprising a carrier body (49) as well as a number "n" of tool-holding modules (50) arranged directly next to one another, and the tool-holding modules (50) are held on the carrier body (49), forming each one of the tool-holding modules (50) so as to have a first coupling means (59) and a first actuating means (60) cooperating with the first coupling means (59) as a component of a coupling device (58), providing a bending tool (86) having a bending die (87) and a bending punch (88), wherein the bending die (87)

is held releasably clamped on the lower press beam (84) and the bending punch (88) is held releasably clamped on the upper press beam (85), to allow for the bending operation to be carried out on the workpiece (2) to be produced, providing at least one bending punch segment (90) and at least one bending punch set (94) comprising multiple individual bending punches (95, 96, 97, 98) to form the bending punch (88), forming the individual bending punches (95, 96, 97, 98) to each have a forming edge (47) and a connecting section arranged at a distance therefrom, wherein the forming edge (47) can be turned towards the workpiece (2) to be formed and the connecting section is held releasably clamped on the upper press beam (85), forming the individual bending punches (95, 96, 97, 98) to each have a coupling section (77) as a component of a coupling device (58), wherein each coupling section (77) delimits a groove-shaped receiving opening (78) with a first groove side face (79), a second groove side face (80) and a groove base surface (81), forming a third coupling means (82) in or on each one of the first groove side faces (79), inserting the tool-holding modules (50) of the tool-changing unit into the groove-shaped receiving openings (78) of the individual bending punches (95, 96, 97, 98), adjusting or activating at least one selected first actuating means (60), wherein in the course of this, the first coupling means (59) of the tool-holding module (50) associated with the first actuating means (60) is brought into coupling engagement with the third coupling means (82) of an individual bending punch (95, 96, 97, 98), releasing the clamping retention of the bending punch (88), displacing the tool-changing unit (39) along with the at least one individual bending punch (95, 96, 97, 98) held coupled thereon.

* * * * *